US006533155B1

(12) United States Patent
Kubota et al.

(10) Patent No.: US 6,533,155 B1
(45) Date of Patent: Mar. 18, 2003

(54) MOUNT DEVICE FOR CONNECTION OF FILAMENT-SHAPED CONNECTING BODIES

(75) Inventors: Mikio Kubota, Tokyo (JP); Kenji Masuyama, Kofu (JP)

(73) Assignee: Toska Co., Ltd., Tokyo (JP)

( * ) Notice: Subject to any disclaimer, the term of this patent is extended or adjusted under 35 U.S.C. 154(b) by 0 days.

(21) Appl. No.: 09/622,899

(22) PCT Filed: Jan. 29, 1999

(86) PCT No.: PCT/JP99/00396

§ 371 (c)(1),
(2), (4) Date: Aug. 31, 2000

(87) PCT Pub. No.: WO00/44628

PCT Pub. Date: Aug. 3, 2000

(30) Foreign Application Priority Data

Aug. 4, 1997 (JP) ..... 9-209255

(51) Int. Cl.[7] ..... B27F 7/00
(52) U.S. Cl. ..... 227/67; 156/556; 156/DIG. 23
(58) Field of Search ..... 156/DIG. 23, 579, 156/556, 566; 227/67, 71; 24/17 AP

(56) References Cited

U.S. PATENT DOCUMENTS 5,497,930 A * 3/1996 Kubota ..... 227/67
5,738,265 A * 4/1998 Hirai et al. ..... 227/67
5,799,375 A * 9/1998 Fukami ..... 24/16 PB
5,906,039 A * 5/1999 Fukami et al. ..... 29/566
6,009,997 A * 1/2000 Deschenes et al. ..... 206/346

FOREIGN PATENT DOCUMENTS

JP 11-29121 A * 2/1999 ..... B65B/51/04
JP 1149125 A * 2/1999 ..... B65C/7/00

* cited by examiner

*Primary Examiner*—Michael W. Ball
*Assistant Examiner*—Todd J. Kilkenny
(74) *Attorney, Agent, or Firm*—Rader, Fishman & Grauer PLLC

(57) ABSTRACT

A method and device for simple and sure connection of a filament-shaped connecting body, comprising forwardly feeding a collecting body of a multiplicity of filament-shaped connecting bodies L comprising a filament part f, a head h and a joining part k into a join groove 6*b* and a head groove 6*a*, which are provided on a side of a body 2, from rearwardly of the body 2, receiving the head h into a head support part 4*d* of a head conveying arm 4, causing the head h to approach a tip end of a hollow needle 5 along a predetermined path from a position spaced from the hollow needle 5, simultaneously causing a rod 10 of a piston 9 to force the joining part k into the hollow needle 5 to fit the same into a latch hole b of the head h to connect the filament part f in a ring-shaped configuration.

12 Claims, 24 Drawing Sheets

Po
P3
17
17a
9g
9i
9

P4
9k 9m
9h
17b
P1
P2

MOUNT DEVICE FOR CONNECTION OF FILAMENT-SHAPED CONNECTING BODIES

TECHNICAL FIELD

The invention relates to a mount method and a mount device, in which filament-shaped connecting bodies made of a synthetic resin and comprising a filament, a head provided on one end of the filament and with a latch hole, and a joining part provided on the other end of the filament and adapted to be securedly fitted into the latch hole of the head are used, and the joining part is securedly fitted into the latch hole of the head to connect the filament in a ring-shaped manner to thereby mount an indication card such as a price tag or the like, to connect two or more articles together and further to connect connecting bodies themselves together, and to filament-shaped connecting bodies.

BACKGROUND OF THE INVENTION

As proposed by the applicant of this application in, for example, Japanese Patent Publication No. 8473/1982, filament-shaped connecting bodies made of a synthetic resin are provided by integral molding of a filament part, which is provided at one end thereof with an annular-shaped head (female part) and at the other end thereof with a joining part (male part), from an industrial synthetic resin such as nylon, polypropylene or the like, and by stretching the filament part to increase strength thereof and to make a cross section thereof small to make the same pliable, and the product according to the invention of the Publication is widely commercially available as "Locks" (trade mark) in Japan and in the world to be used for various applications such as mounting of a price tag or the like.

The head is annular or cylindrical in shape and is formed centrally therethrough with a latch hole, which is formed in a middle portion thereof with a diametrically extending, annular engagement step. Meanwhile, the joining part includes a neck dimensioned to pass through the engagement step, and latch pieces projecting on both sides of the neck in a vane-like configuration, the latch pieces being supported by and engaged with the engagement step.

Such filament-shaped connecting body is such that in a state, in which the filament part is made to encircle a part of goods to be formed in a ring-shape, the joining part can be inserted from either side of the head to be fitted into the head, and thus the filament part can be formed in a ring-shape in one-touch operation by connection of the head and the joining part, so that it can be effectively used when various indication cards (tags) such as a price tag and so on are mounted to goods, such as handbags, bags, footwear, for example, sandals, and so on, having string-shaped portions, and holes such as button holes and a combination of connecting bodies in the form of chain is used to connect to a show shelf goods being shown.

By the way, when such filament-shaped connecting body is to be used, there is the need of an operation of encircling the connecting body around a handle of, for example, a handbag or the like, fitting the joining part into the hole of the head for connection in a state which the joining part of one connecting body is throughout into the hole of the indication card. However, such connecting operation requires manipulation by both hands because it is necessary to hold goods and the head with one hand and to manipulate the joining part with the other hand, and so such manipulation is troublesome and inefficient, so that various mount devices have been investigated, which is capable of performing such operation.

Mount devices have been proposed in, for example, Japanese Patent Publication Nos. 35489/1988 and 14704/1991. The-mount device described in Japanese Patent Publication No. 35489/1988 includes a grip part and a grip rod, which are connected at central portions thereof to each other to provide a construction like nippers as a whole. The head and the joining part are connected between a latch guiding arm being an extension of the grip part and a movable arm being an extension of the grip rod to present a state, in which goods is grasped.

However, such device gets in a state, in which it interposes a portion of goods between the grip part and the grip rod, to push the goods to possibly damage the same, and moreover the filament part is disposed between the latch guiding arm and the movable arm to be arranged in a U-shaped configuration, so that there is produced no space, into which a portion of goods having mounted thereto an indication card is inserted, that is, "space", in which the mounting operation is performed. Also, there is involved a problem that the operation becomes quite troublesome since the filament part having been bent into a U-shape above the mount device will contact with goods when the device is to be manipulated.

On the other hand, with the arrangement described in Japanese Patent Publication No. 14704/1991, a lower beak is provided in such a manner that manipulation of a lever causes the same to come toward and away from an upper beak provided forwardly of a body, and the both beaks are provided with guide grooves, respectively, whereby upon forward and rearward operations of a single pulley cause a belt-shaped article connected to the pulley to alternately enter into the guide grooves of the upper and lower beaks to thereby feed a head of a filament-shaped connecting body to a side of the upper beak and feed a joining part to a side of the lower beak, and to subsequently make the lower beak approach the upper beak to connect the head and the joining part to each other.

Since such device uses the single pulley to alternately guide the head and the joining part of the filament-shaped connecting body into the upper and lower beaks, however, it is necessary to precisely and rapidly grasp the head or the joining part at a tip end of the flexible body, and further the opening and closing motions of the lower beak relative to the upper beak are added to require a considerably complex movement, so that there are involved failure in a motion for receiving the head or the joining part, failure in the connecting motion or the like, and further a problem in durability in terms of mechanisms.

Also, a similar device has been proposed in Japanese patent application Kokai publication No. 310520/1996, which comprises a reception guide for guiding a L-shaped head in front of a body and an insertion guide so that a belt is used to insert the head into the reception guide and a pipe provided at a tip end of a piston supports the insertion part and is forced into the insertion guide together with an inserting part.

With such device, however, the reception guide projects in front of the body at all times to be liable to interfere with the connecting operation, and the forcing-in operation is unstable since the head is forced into the reception guide by the belt. Further, because connecting bands arranged on both sides of the filament-shaped connecting body are inserted into guide holes, which are provided on both sides of a forward portion of the body in a longitudinal direction, and the lower connecting band is struck out, so that there is a problem that the filament-shaped portion bends over a top surface of the body to easily cause the filaments to get entangled, thus tending to causing a trouble.

As described above, conventional mount devices involve various problems, and are not products that are entitled to be salable.

A first requirement in developing such mount device for filament-shaped connecting bodies is the capability of simply loading a collecting body of a multiplicity of filament-shaped connecting bodies into the device and separating individual filament-shaped connecting bodies from the collecting body to rapidly feed them to a part where the connection operation is performed.

A second requirement is the capability of forming an adequate space (bosom portion or distance for receiving an article, to which a filament-shaped connecting body is mounted), which can receive an article, to which a filament-shaped connecting body go around, and inhibiting filament portions from getting entangled.

A third requirement is to surely convey a collecting body of a multiplicity of filament-shaped connecting bodies in front of the body and rapidly make them assume a striking posture.

A mount method, a mount device and a collecting body of a multiplicity of filament-shaped connecting bodies, according to the invention are directed to providing a device that can solve the above-mentioned various problems of the prior art.

DISCLOSURE OF THE INVENTION

1) To attain the above-mentioned object, a method for connection of filament-shaped connecting bodies, according to the invention, and for loading into a mount device a collecting body of a multiplicity of filament-shaped connecting bodies L connected in parallel between two flexible members J, J through connecting parts c of reduced cross section, the filament-shaped connecting bodies comprising a filament part f, a head h formed on one end of the filament part and having a latch hole b therethrough, and a joining part k formed on the other end of the filament part and adapted to fit into the latch hole b to elastically engage therewith, and for fitting the joining part k into the latch hole b of the head h for connection, the method comprising the steps of:

loading heads h and joining parts k, which are arranged on the flexible members J, J of the collecting body of filament-shaped connecting bodies L, into a head groove 6*b* and a join groove 6*a* extended from a rear portion of a body 2 of the mount device 1 to a forward portion thereof, respectively, supporting filament parts f in a state, in which they are bent in a U-shaped manner to project laterally of the body 2, and feeding the collecting body forwardly of the body 2 from rearwardly thereof;

receiving a head h into a head support part 4*d* of a head conveying arm 4 in a position in front of the body 2 and spaced a distance, which receives an article being subjected to mounting, from an axis of a hollow needle 5 projecting in a forward portion of the body 2;

having the head conveying arm 4 approaching the axis of the hollow needle 5 along a predetermined path from the position spaced from the hollow needle 5 while advancing the head conveying arm 4, and having the head h standing by at a tip end of the hollow needle; and causing a rod 10 provided on a piston 9 to force the joining part k into the hollow needle 5 at an inlet of the hollow needle to push the same out of a discharge port and to fit the joining part k into the latch hole b of the head h to connect the filament part f into the latch hole b of the head h, which has stood by immediately before the discharge port, in a ring-shaped manner.

2) The method for connection of filament-shaped connecting bodies described in 1), further comprises the step of feeding from rearwardly of the mount device 1 two flexible members J, J disposed on both sides of a multiplicity of filament-shaped connecting bodies L arranged in parallel to cause them to go around a joining part feed gear 14*a* and a head feed gear 14*b*, which are disposed in a forward portion of the mount device 1, and move rearward and to be conveyed along a laterally directed path, and in the above step causing the head conveying arm 4 to grasp one of the heads h in a position where the flexible members J, J go around peripheral surfaces of the two gears 14*a*, 14*b*, causing the rod 10 provided on a tip end of the piston 9 to force one of the joining parts k into the hollow needle 5 provided in a forward portion of the mount device 1 to fit the joining part k into the latch hole b of the head h, which has stood by immediately before the discharge port of the hollow needle 5, to thereby connect the filament part f in a ring-shaped manner.

3) A mount device for connection of filament-shaped connecting bodies, according to the invention, comprises a lever 3 supported on a forward portion of a grip part 2*c* of a hollow body 2 to appear and disappear, an intermediate lever 3A driven by the lever 3, a piston 9, which is guided to move in a forward and backward direction of the body 2 and with which the intermediate lever 3A engages, a rod 10 extended forward from the piston 9 for pushing out a joining part k, a hollow needle 5 disposed axially of the rod 10 to be mounted in the body 2, a gear feed lever 12 adapted to turn upon reciprocation of the piston 9, a joining part feed gear 14*a* and a head feed gear 14*b*, which are disposed in a forward end portion of the body 2, ratchet wheels 15*a*, 15*b*, respectively, provided adjacent the both gears 14*a*, 14*b*, feed pawls 12*f*, 12*g* incorporated into pawl support parts 12*d*, 12*e* provided at a tip end of the gear feed lever 12 and adapted to mesh with the ratchet wheels 15*a*, 15*b*, respectively, a head groove 6*b* and a join groove 6*a*, which are formed to communicate to feed positions of the joining part k and of the head h on peripheral surfaces of the joining part feed gear 14*a* and the head feed gear 14*b*, and a head conveying arm 4 driven by the piston 9 and supported by a swinging linkage including a parallel linkage, and wherein the head conveying arm 4 grasps a foremost head h in a position of the head feed gear 14*b*, to which filament-shaped connecting bodies L are supplied, and moves the same along a predetermined path by means of a linkage supporting the head conveying arm 4 to make the same stand by immediately before a discharge port of the hollow needle 5, and in the mean time the rod 10 projecting at a tip end of the piston 9 causes a foremost joining part k in a position of the joining part feed gear 14*a*, to which filament-shaped connecting bodies L are supplied, to be inserted and latched into the latch hole b of the head h grasped by the head conveying arm 4.

4) The mount device for connection of filament-shaped connecting bodies, described in 3), is constructed such that heads h and joining parts k of filament-shaped connecting bodies L are intermittently pushed out to be connected to each other by the gripping operation of the lever 3, which is provided on a forward portion of a grip part 2*c* of the body 2 of the mount device 1 in a manner to be elastically pushed out;

the gripping operation of the lever 3 causes the gear feed lever 12 to turn interlocking with advancement of the piston 9, and stores an elastic force in a spring 12*h* connected to the gear feed lever 12 upon turning of the gear feed lever 12, and the releasing operation of the lever 3 causes the gears 14*a,* 14*b* to rotate making use of the elastic force of the spring 12*h;* and the gear feed lever 12 stores an elastic force in the spring 12*h* in a former stage of the turning, and in a latter stage performs connection of the head h and the joining part k with each other in a state, in which the elastic force is preserved in the spring 12*h,* and releases the elastic force from the spring 12*h* upon the releasing operation of the lever 3 to thereby convey the filament-shaped connecting bodies L.

5) The mount device for connection of filament-shaped connecting bodies, described in 3), is constructed such that the gear feed lever 12 comprises a guide surface 12E for inclining the lever 12 interlocking with advancement of the piston 9 in a former stage of the gripping operation of the lever 3 to store an elastic force in a spring 12*h,* and a guide surface 12K contiguous to the guide surface 12E in a doglegged configuration for maintaining a posture of the lever 12 in a latter stage of the gripping operation during advancement of the piston 9, and a guide body 12L, which is turnably provided to cooperate with the guide surface 12E to assume a V-shape and of which a tip end is contiguous to the guide surface 12K;

an elastic force is stored in the spring 12*h* while an actuating part 11 adapted to move on the guide surface 12E together with the piston 9 moves, connection of a connecting body L is carried out while the actuating part 11 moves on the guide surface 12K, a posture of the lever 12 is maintained while the actuating part 11 moves on a guide surface of the guide body 12L, and when the actuating part 11 gets out of an end of the guide body 12L. the elastic force of the spring 12*h* causes the gear feed lever 12 to swing to move a filament-shaped connecting body L to a succeeding striking position.

6) In the mount device for connection of filament-shaped connecting bodies, described in 3), the joining part feed gear 14*a* and the head feed gear 14*b* are provided in a forward portion of the body 2, and paths are formed in the body 2, along which flexible members J, J are caused to engage with halves of peripheries of the both gears 14*a,* 14*b,* and are discharged.

7) The mount device for connection of filament-shaped connecting bodies, described in 3), comprises pawl support parts 12*d,* 12*e,* respectively, formed on a tip end of the gear feed lever 12 in a bifurcate manner, and feed pawls 12*f,* 12*g* provided on and supported by the pawl support parts 12*d,* 12*e* to mesh with ratchet wheels 15*a,* 15*b,* respectively, which are provided adjacent the joining part feed gear 14*a* and the head feed gear 14*b,* and to project forward by elastic forces.

8) The mount device for connection of filament-shaped connecting bodies, described in 3), comprises a first base plate 20 and a second base plate 22 arranged in parallel between a righthand body 2*a* and a lefthand body 2*b,* which constitute the body 2, the joining part feed gear 14*a* and the head feed gear 14*b* being disposed on a forward portion of one surface of the first base plate 20, a head groove 6*b* and a join groove 6*a* provided in a longitudinal direction of the body 2 in a manner to communicate to feed surfaces of the joining part feed gear 14*a* and the head feed gear 14*b,* the rod 10 being provided on the piston 9 in a manner to move transversely in a diametrical direction of the joining part feed gear 14*a,* the hollow needle 5 being disposed forwardly axially of the rod 10, the second base plate 22 being provided on one surface thereof with a guide groove 9A for guiding the piston 9, and with a first link 17, a second link 18, a third link 4*b* and fourth links 4*a,* 4*a′,* which are driven by the piston 9, the head conveying arm 4 pivotally mounted to upper ends of the third link 4*b* and of the fourth links 4*a,* 4*a′*defining a parallel linkage, and further the mount device comprises the gear feed lever 12, the ratchet wheels 15*a,* 15*b* driven by the gear, feed lever 12, and the joining part feed gear 14*a* and the head feed gear 14*b,* which are fixed to shafts of the ratchet wheels 15*a,* 15*b.*

9) The mount device for connection of filament-shaped connecting bodies, described in 8), a stoppage mechanism for maintaining a position where parts constituting the parallel linkage inclines foremost.

10) In the mount device for connection of filament-shaped connecting bodies, described in 8), the stoppage mechanism is actuated upon contact of an end of at least one of the fourth links 4*a,* 4*a′*with a shaft 14*h* of the head feed gear 14*b.*

11) The mount device for connection of filament-shaped connecting bodies, described in 8), comprises a stoppage member provided between the head conveying arm 4 and the body 2 to prevent vibration in a position where the head conveying arm 4 is returned.

12) In the mount device for connection of filament-shaped connecting bodies, described in 8), the stoppage member comprises members for providing magnetic attraction and fixing between the head conveying arm 4 and the body 2.

13) The mount device for connection of filament-shaped connecting bodies, described in 3), comprises a manual feed roller 19 arranged midway between the ratchet wheels 15*a,* 15*b* to drive them.

14) The mount device for connection of filament-shaped connecting bodies, described in 8), further comprises stoppers 24, 24A arranged on sides of the ratchet wheels 15*a,* 15*b,* and a stopper release body 8A for releasing engagement between the stoppers 24, 24A and the joining part feed gear 14*a* and the head feed gear 14*b.*

15) A collecting body of filament-shaped connecting bodies, applied to the invention, a collecting body is made by integral molding of a synthetic resin, and composed of filament-shaped connecting bodies L, which comprise a filament part f, a head h disposed on one end of the filament part and formed centrally thereof with extending through a latch hole b, and a joining part k disposed on the other end of the filament part, the head h and the joining part k being disposed between two flexible members J, J with connecting parts c of reduced cross section therebetween, the latch hole b of the head h extends perpendicularly through a plane, in which the collecting body is disposed, and the joining part k is formed in a direction perpendicular to the plane, in which the collecting body is disposed.

16) The collecting body of filament-shaped connecting bodies, described in 15), comprises latch pawls t provided on both sides of an outlet of the latch hole b extending through the head h and opposed to each other.

BEST MODE FOR CARRYING OUT THE INVENTION

[Whole Constitution]

An outward appearance of a mount device 1 for a filament-shaped connecting body is shown in FIGS. 1 to 5.

Figure 27:
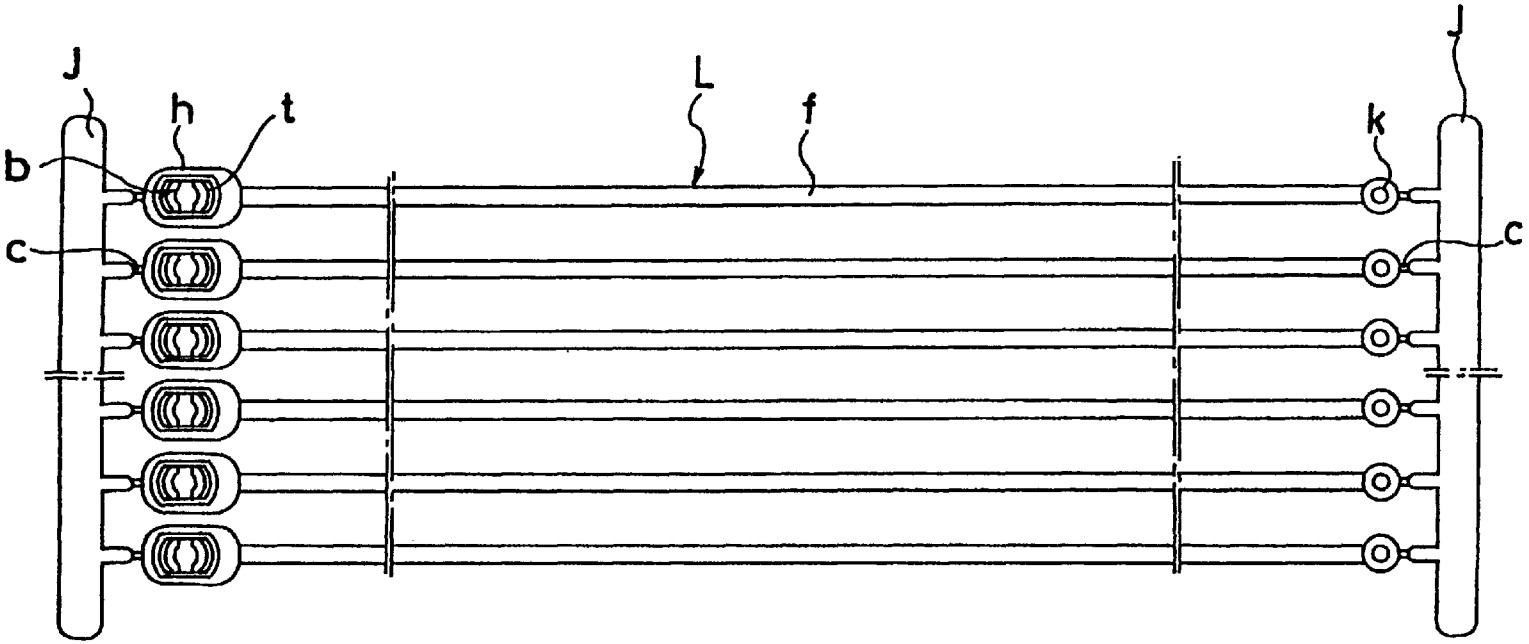
FIG. 27 is a front view showing a collecting body composed of filament-shaped connecting bodies.
Figure 28:
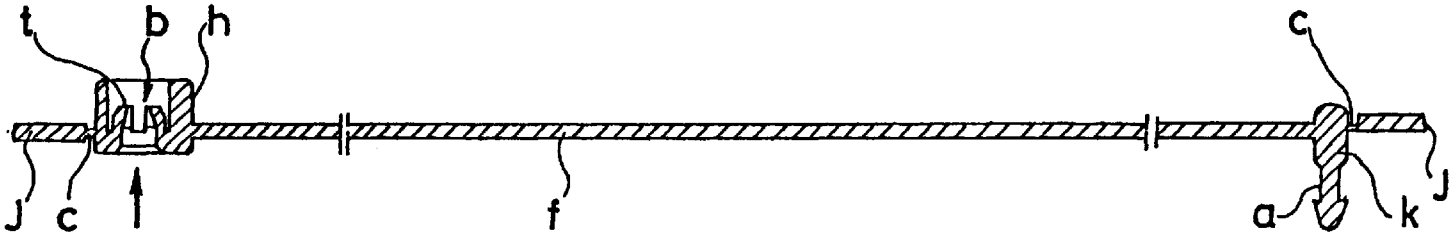
FIG. 28 is a side cross sectional view showing a collecting body composed of filament-shaped connecting bodies.

The mount device 1 charges thereinto and uses a sheet-shaped body formed as an aggregated body by integral molding and comprising two flexible members J, J (portions functioning as runner bars at the time of molding and as collecting members) disposed on both sides as shown in FIGS. 27 and 28 in parallel, filament-shaped connecting bodies L disposed perpendicular to the flexible members J, J and in parallel to one another, and connecting parts c (portions functioning as gates at the time of molding) individually reduced in cross section, the aggregated body being disposed separably through the connecting parts.

The filament-shaped connecting bodies L comprises a filament part f, a somewhat flat cylindrical-shaped head (female part) h provided on one end of the filament part, and a joining part k (male part) provided on the other end of the filament part and adapted to be fitted into a latch hole b of the head h, the latch hole b being formed therein with two elastically movable engaging pawls t facing each other, the joining part k being adapted to be fitted into the latch hole b in a direction shown by an arrow in FIG. 28 whereby the engaging pawls t are allowed to elastically engage with and grasp a mushroom-shaped neck a formed in the vicinity of a tip end of the joining part k to connect the filament part f in a ring-like manner.

Specifically, the joining parts k and the heads h formed on the filament-shaped connecting bodies L are formed perpendicular to the filament parts f in order to facilitate connecting operation by means of the mount device of the invention. These filament-shaped connecting bodies L are used in mounting an indication tag, such as a label, to goods, such as bags, for example, handbags and so on, and sandals, in the form of string or band and having a portion sized to make winding of the filament part f easy, and to goods having a hole such as button holes.

Figure 4:
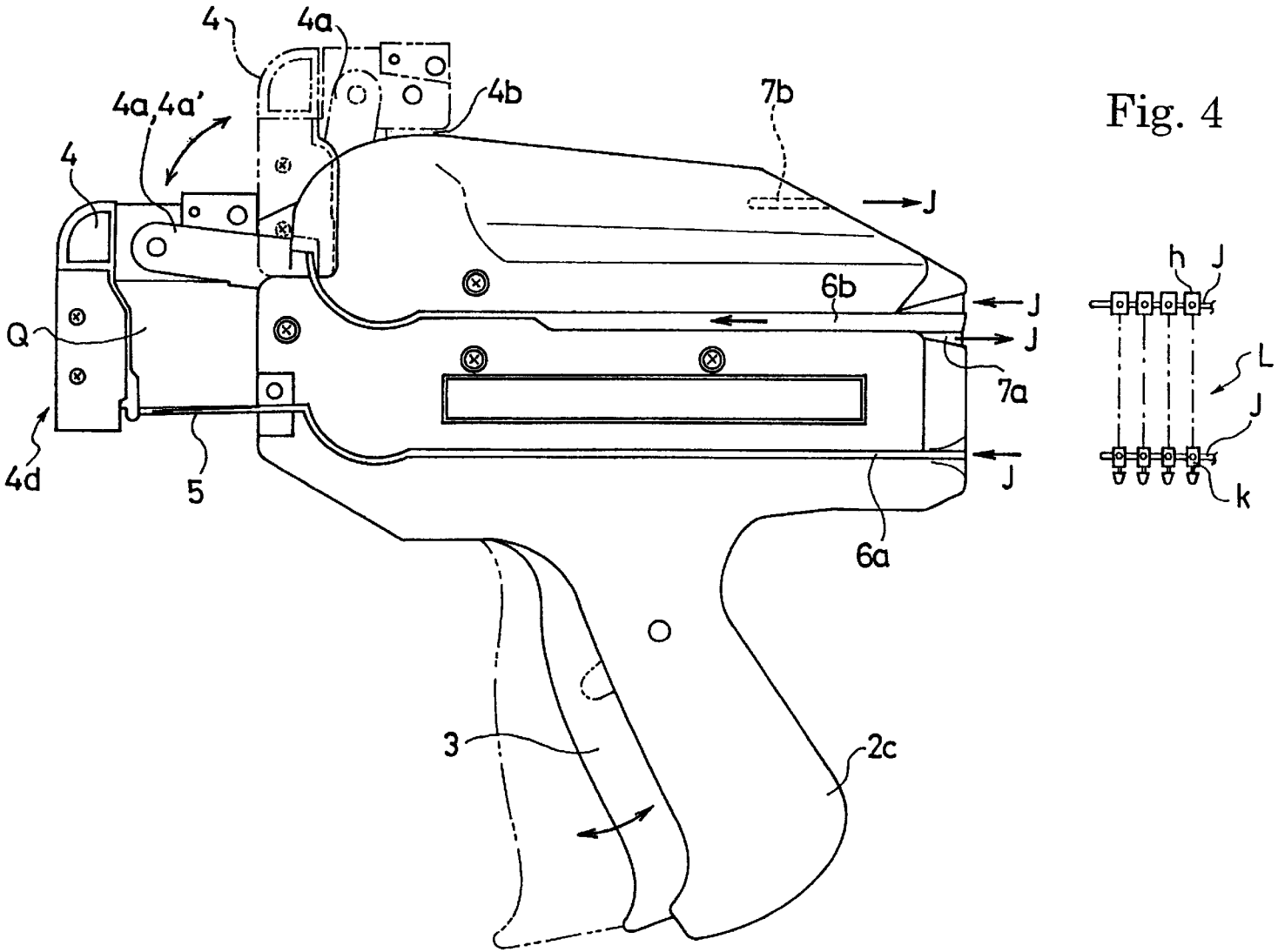
FIG. 4 is a righthand side view showing the mount device for a filament-shaped connecting body.

The mount device 1 has an outward appearance such that a righthand body 2*a* and a lefthand body 2*b,* which are moldings of a synthetic resin, are made to overlap together to form a substantially pistol-shaped body 2, and a lever 3 is provided in front of a grip part 2*c* to elastically appear outside and disappear inside as shown in FIG. 4.

Figure 5:
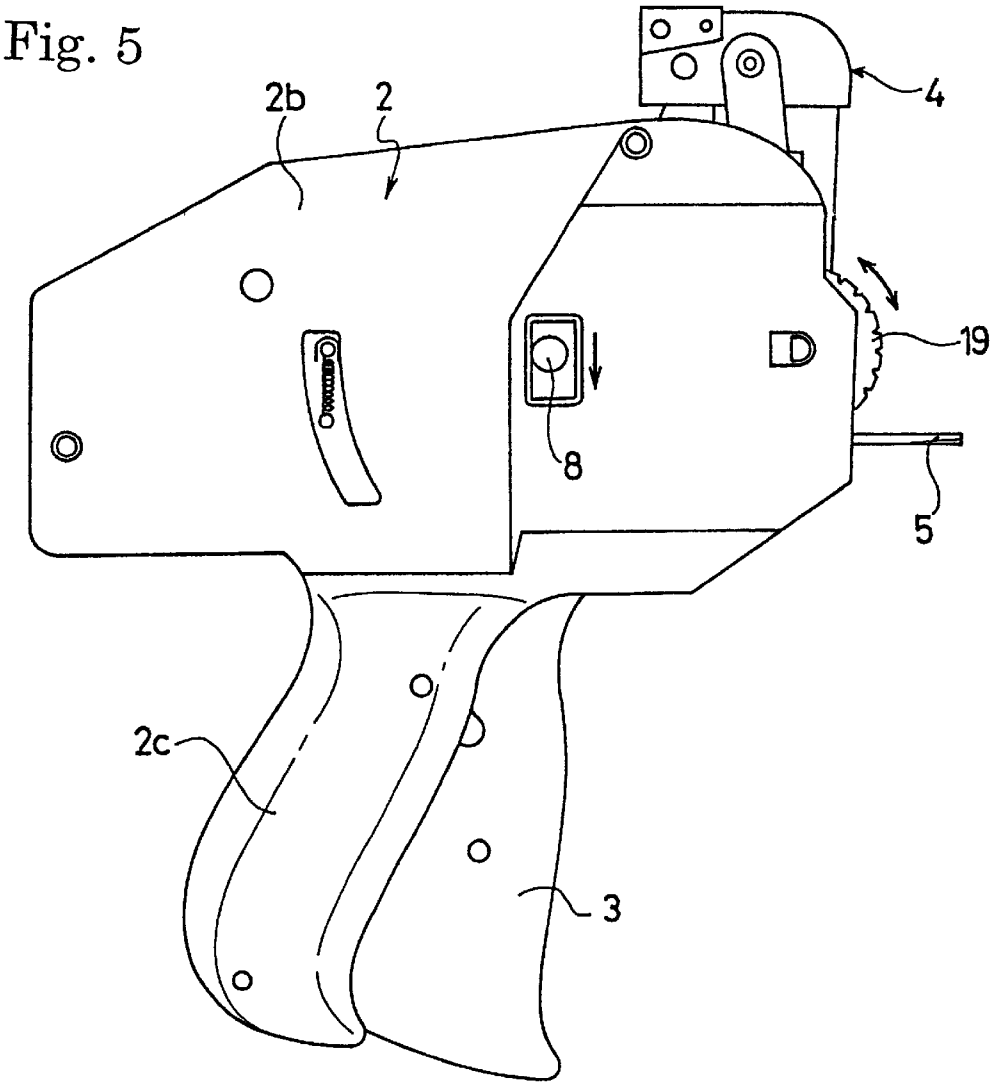
FIG. 5 is a lefthand side view showing the mount device for a filament-shaped connecting body.

A portion of a manual feed roller 19 is exposed in front of the body 2 as shown in FIG. 5, and is turned with a finger tip to thereby enable manually feeding a collecting body of the filament-shaped connecting bodies L to load the same in the mount device 1, or a release knob 8 shown in FIG. 5 is operated downward to shut off engagement with a feed mechanism composed of feed gears described later to enable taking out a non-used collecting body.

Figure 1:
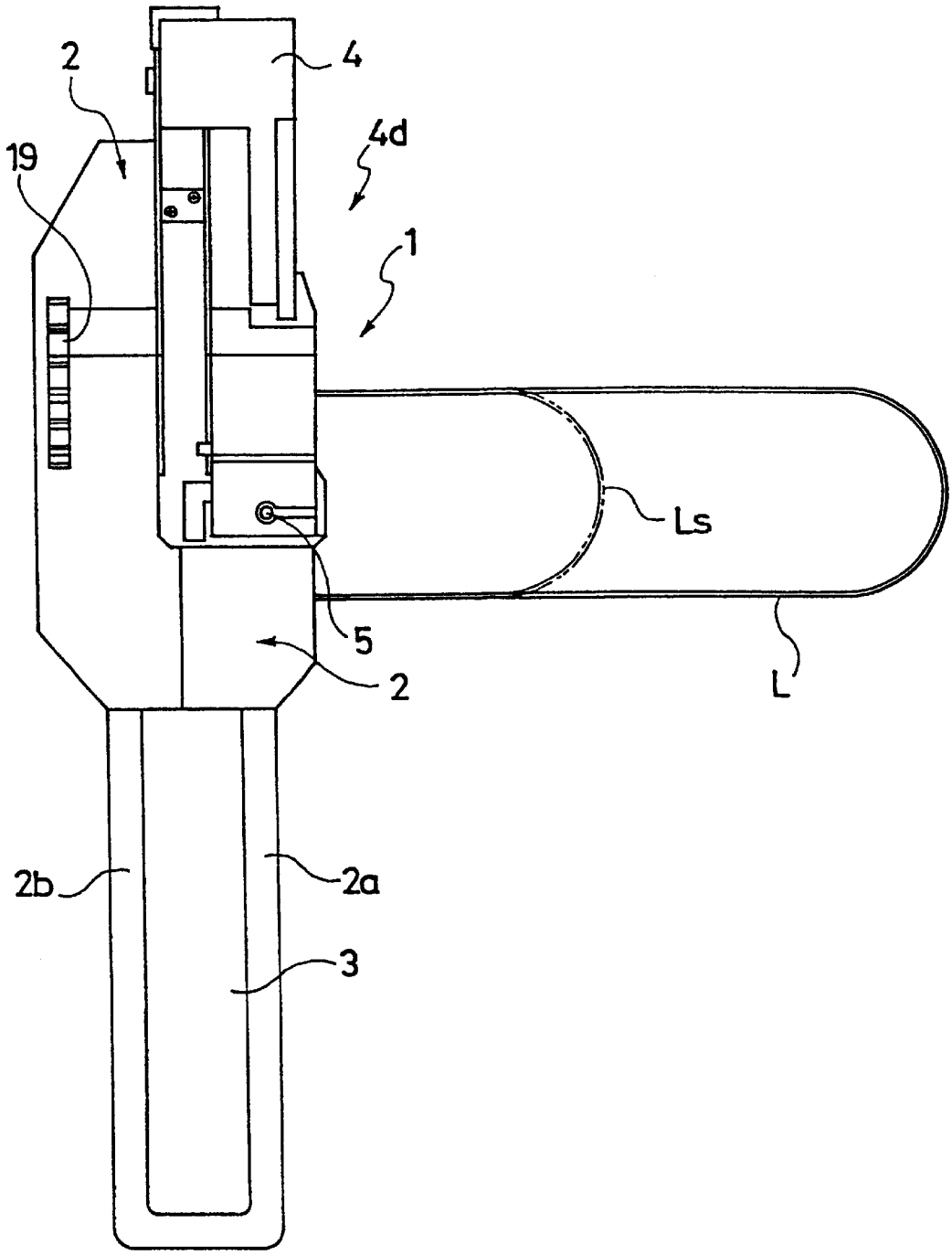
FIG. 1 is a front view showing a mount device for a filament-shaped connecting body.
Figure 2:
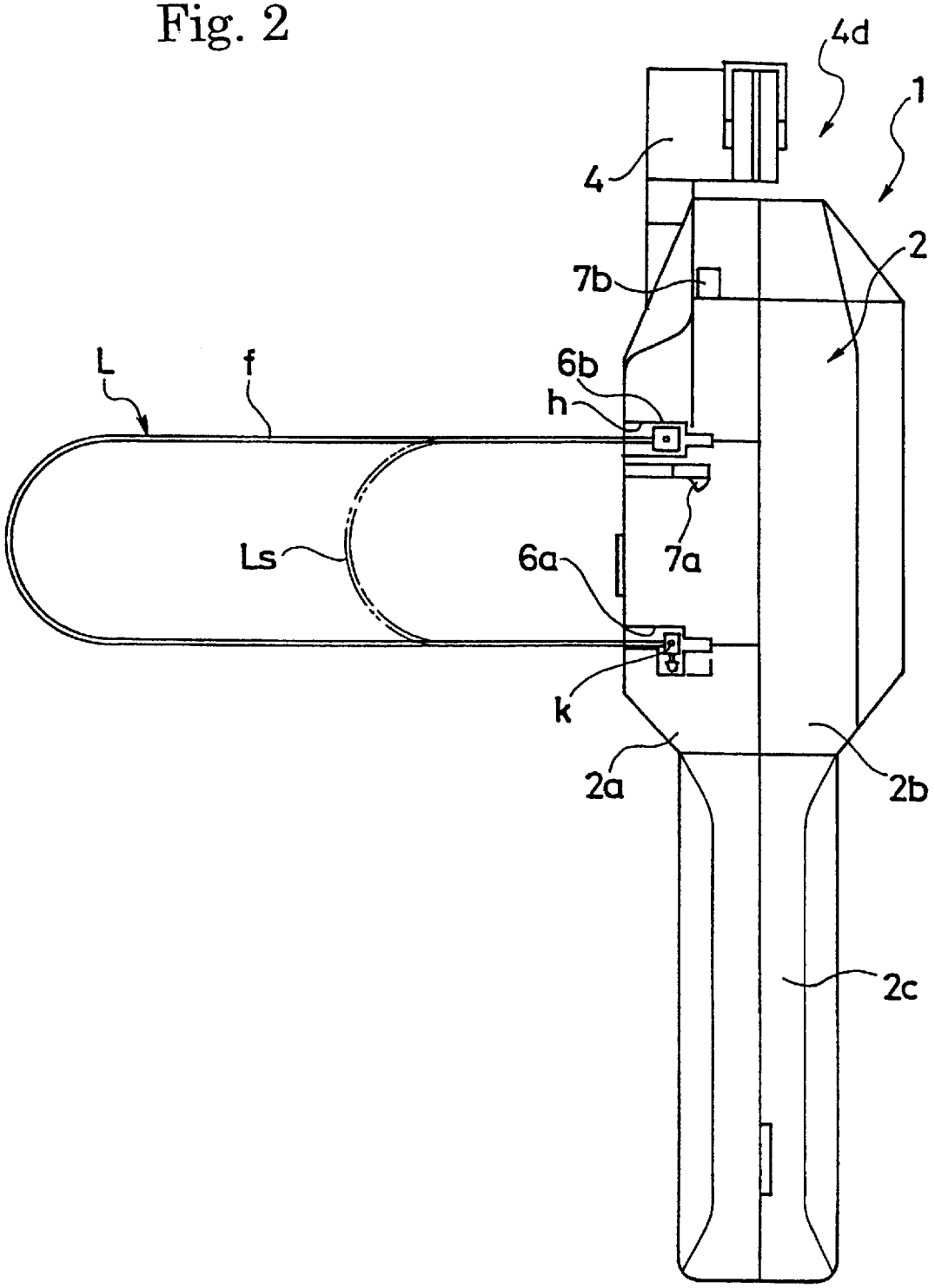
FIG. 2 is a rear view showing the mount device for a filament-shaped connecting body.
Figure 3:
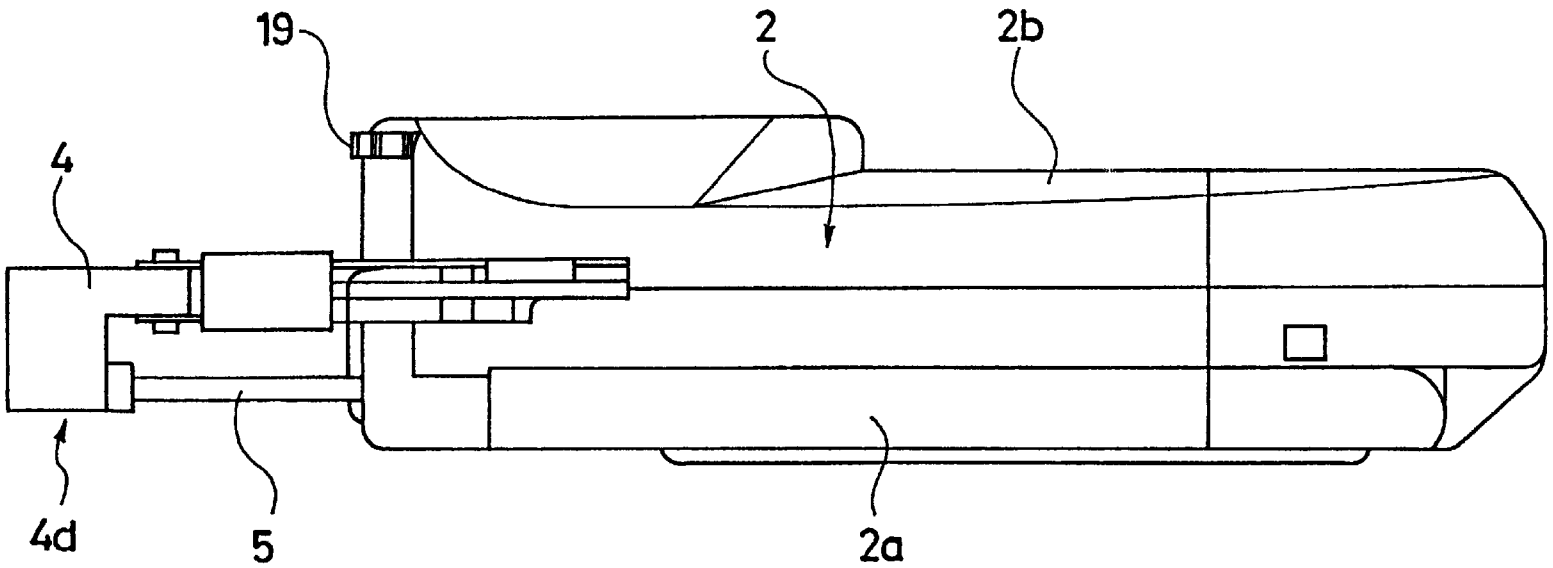
FIG. 3 is a plan view showing the mount device for a filament-shaped connecting body.

Heads h connected to the flexible members J, J on a collecting body of the filament-shaped connecting bodies L shown in FIGS. 27 and 28 are inserted into a head groove 6*b* formed lengthwise of a side of the body 2 as shown in FIG. 4, and the joining parts k connected to the other flexible member J are inserted into a lower side join groove 6*a,* whereby the filament parts f are loaded in a state, in which they are bent in a horizontal U-shaped configuration as shown in FIGS. 1 and 2.

The lever 3 is operatively grasped and released whereby the filament part f is connected in a ring-like manner in a state of connecting operation shown in FIG. 4. In addition, the character L designates a longer connecting body and the character Ls designates a shorter connecting body in FIGS. 1 and 2.

Figure 6:
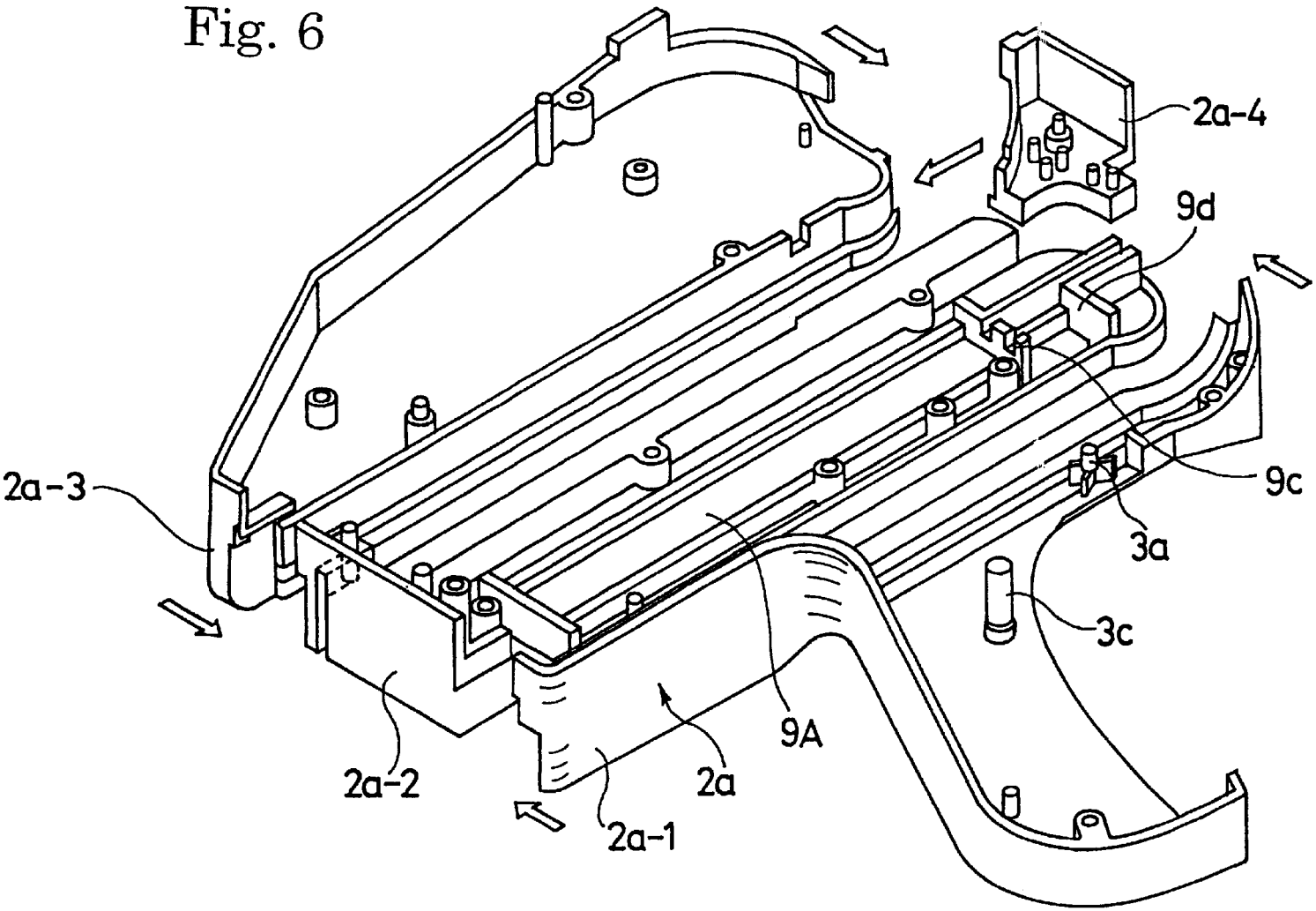
FIG. 6 is a perspective view showing an internal construction of a righthand body.

FIG. 6 is a perspective view showing an internal construction of the righthand body 2*a,* which is separately composed of a first righthand body 2*a*-1, a second righthand body 2*a*-2, a third righthand body 2*a*-3, and a lid 2*a*-4 for opening and closing a tip end of the righthand body. The reason for this is that it becomes to locally disassemble the righthand body 2*a* to open a necessary portion to simply and rapidly adjust and repair the same.

The second righthand body 2*a*-2 is formed with a guide groove 9A for guiding a piston 9, described later, back and forth, and the first righthand body 2*a*-1 is formed integrally with a shaft 3*c* for an intermediate lever 3A (FIG. 7) and a shaft 3*a* for the lever 3.

[Summary of Internal Construction]

Figure 7:
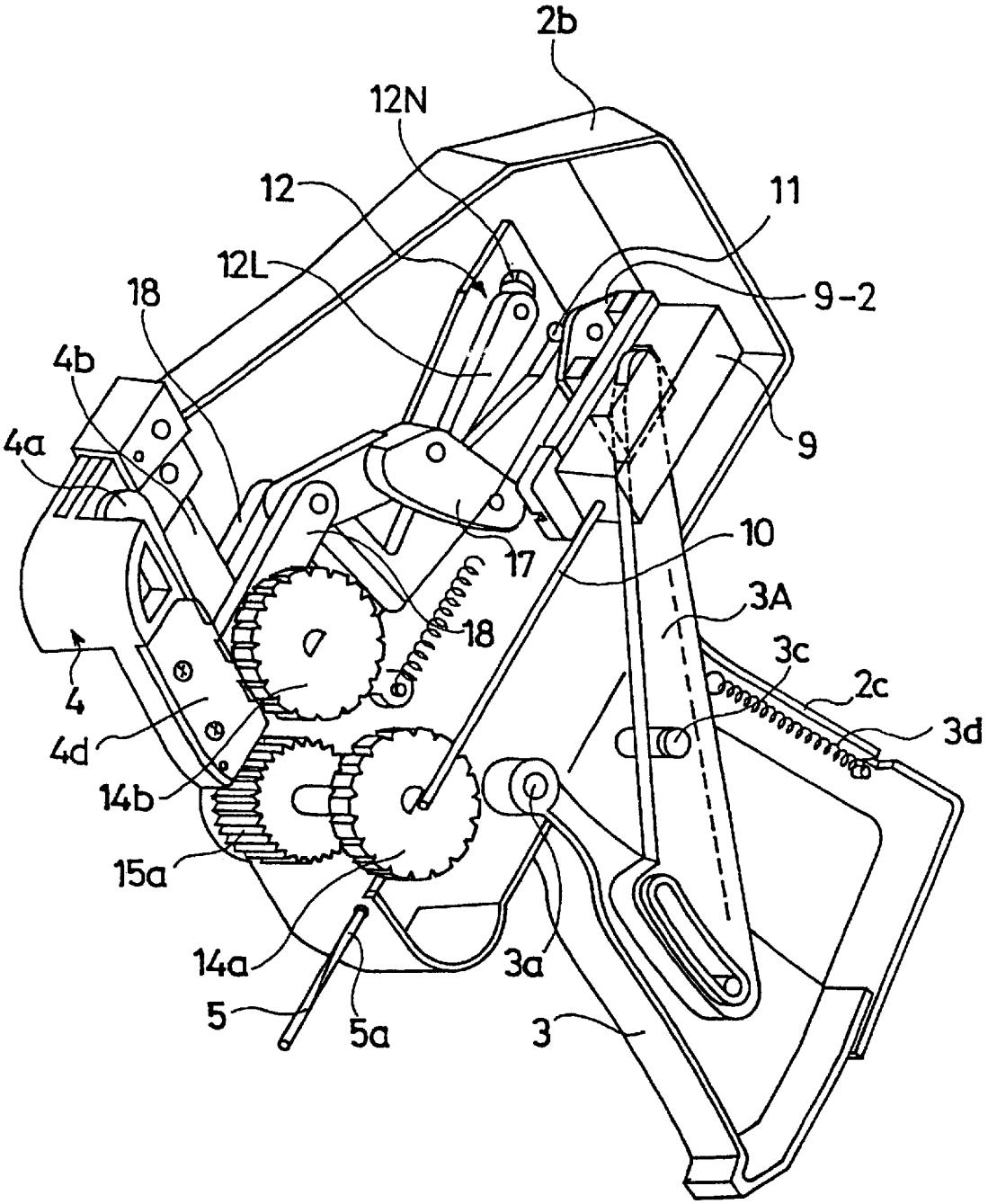
FIG. 7 is a perspective view showing a state of an interior of the mount device prior to connection of a filament-shaped connecting body.
Figure 8:
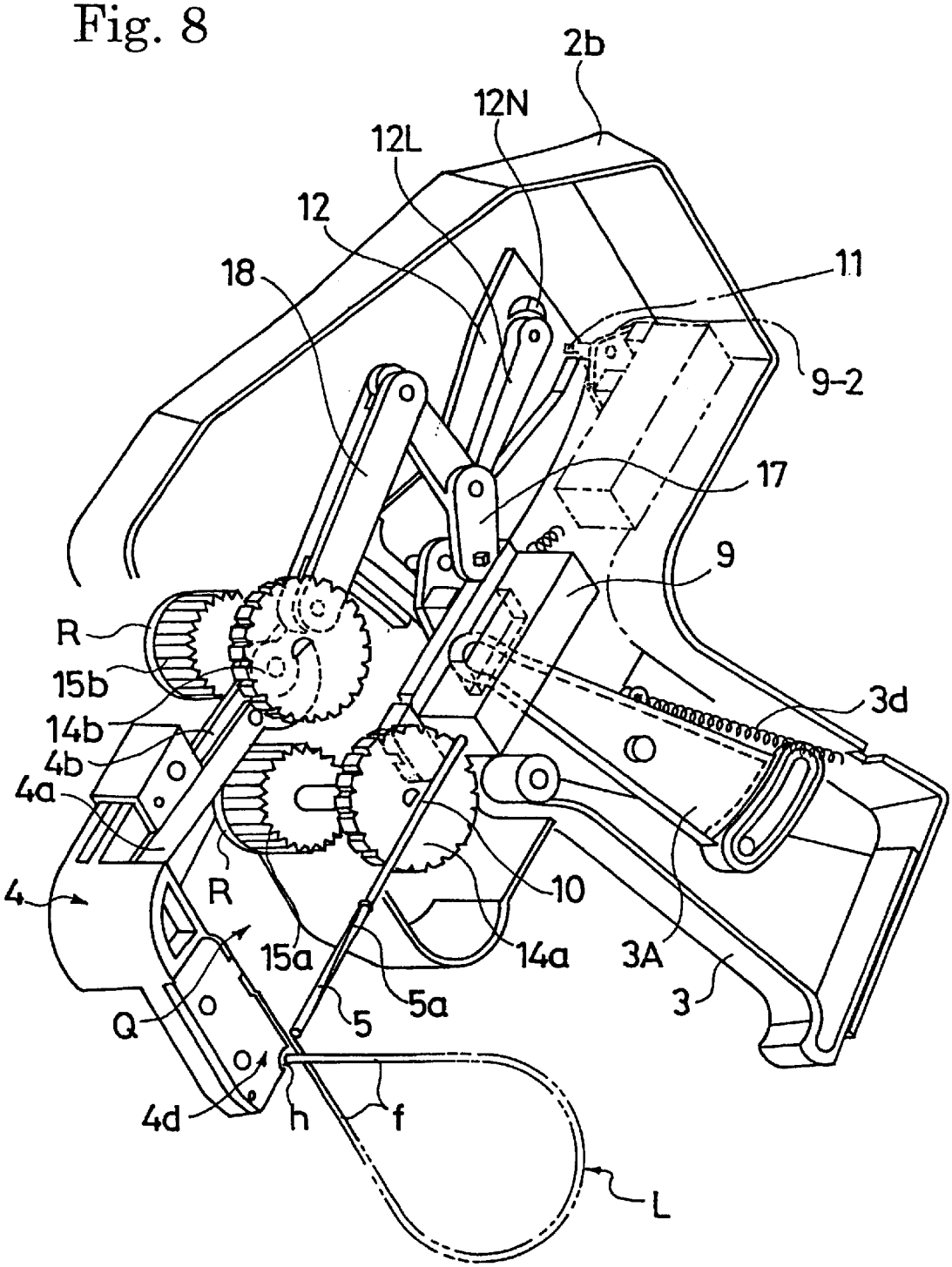
FIG. 8 is a perspective view showing an inner mechanism of the mount device immediately after connection of a filament-shaped connecting body.
Figure 9:
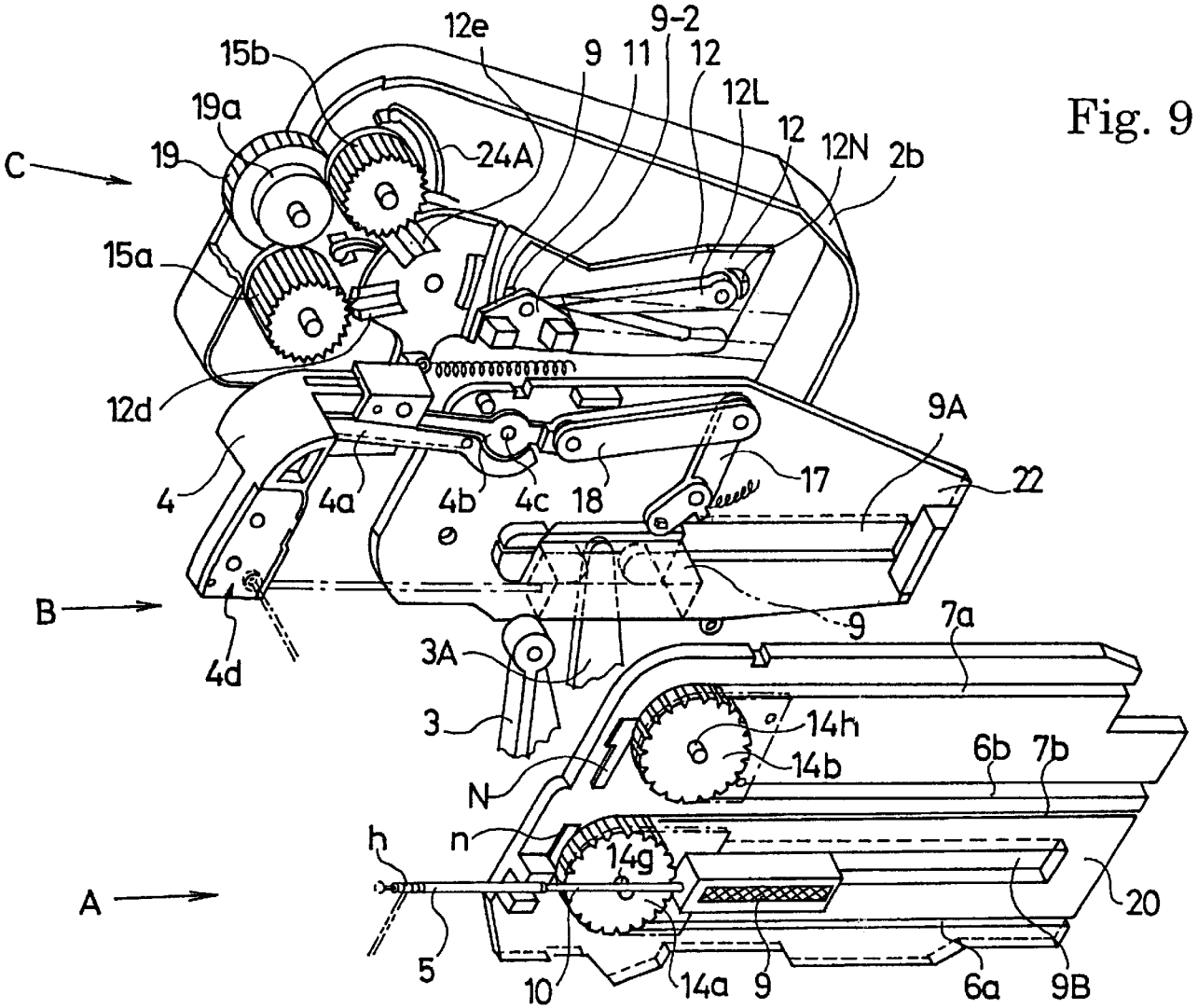
FIG. 9 is a perspective view showing in an exploded state the inner mechanism of the mount device, which is formed in a layered manner.

The internal construction of the mount device 1 is shown in FIGS. 7, 8 and 9, and FIG. 8 specifically shows a state, in which a head h of a filament-shaped connecting body L is received in a head support part of a tip end of a head conveying arm 4 and prior to striking, and FIG. 9 shows a state immediately after a state, in which striking is effected to attain connection of the head h and a joining part k.

The lever 3 in front of the grip part 2*c* formed on a lower portion of the body 2 is pivotally supported by the shaft 3*a* to appear and disappear at an opening in a forward portion of the grip part 2*c* due to an elastic force of a spring 3*d* engaged by the intermediate lever 3A. Movements of the lever 3 enable guiding the piston 9, through the intermediate lever 3A, along the guide groove 9A shown in FIG. 6 to reciprocate the same back and forth. At the same time, a rod 10 for pushing out a joining part k of the filament-shaped connecting body L is caused to reciprocate together with the piston 9.

Provided on an extension of the rod 10 and in a forward portion of the body 2 is a hollow needle 5 provided on a side thereof with a gently spiral-shaped groove 5*a,* which serves for passage of a filament part f, so that the joining part k is forced into an interior of the needle to project from a discharge port at a forward portion of the needle to engage with a head h having stood by immediately in front of the hollow needle 5.

Figure 26:
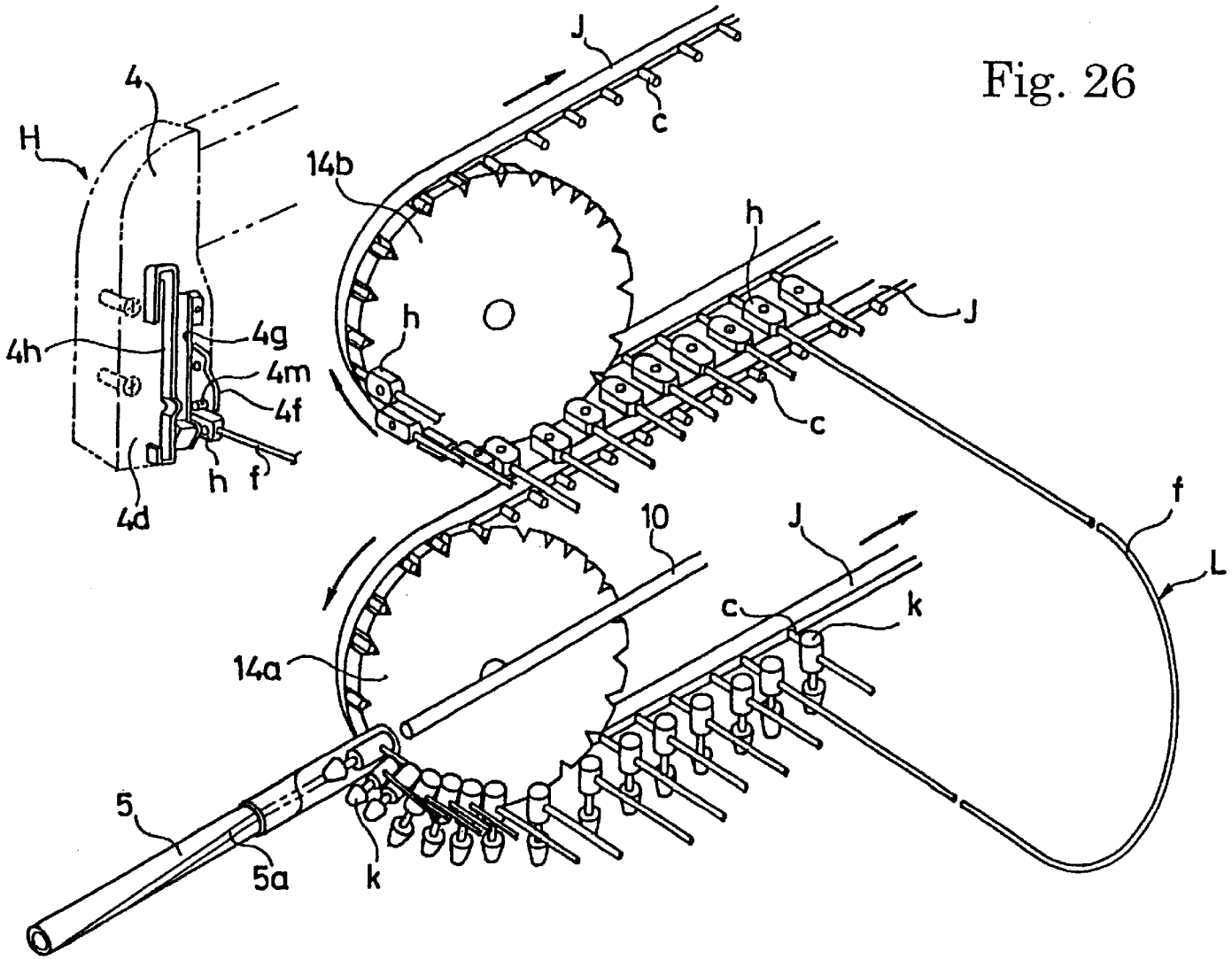
FIG. 26 is a perspective view showing a state, in which filament-shaped connecting bodies are conveyed by a joining part feed gear and a head feed gear.

Provided above and below and laterally of a surface, on which the rod 10 moves, are a joining part feed gear 14*a* and a head feed gear 14*b,* which have grooves having a pitch equal to a pitch, at which filament-shaped connecting bodies L are aligned, whereby the grasping operation of the lever 3 causes intermittently advancing a single filament-shaped connecting body L. In addition, FIG. 26 shows a state, in which filament-shaped connecting bodies L connected perpendicularly to two connecting bands J, J are moved to a striking position by the joining part feed gear 14*a* and the head feed gear 14*b,* striking is effected, and only the remaining connecting bands J. J are transferred rearward.

As shown in FIG. 9, the body 2 includes a first base plate 20 and a second base plate 22, which are arranged in a laminate manner, and respective mechanisms assembled with the use of the base plates, a "A part" representing a pushing mechanism for the joining part k, a "B part" representing a drive mechanism for the head conveying arm, and a "C part" representing a feed mechanism for the filament-shaped connecting bodies L.

Respective mechanisms constituting the mount device 1 of the invention are assembled as subassemblies by compartmenting an interior of the body 2 in a thickness wise direction by the first base plate 20 and the second base plate 22, and making use of these first base plate 20 and second base plate 22, so that an operation of assembling a multiplicity of parts is easy and the mount device can be made durable.

[Feed Mechanism for Piston and Connecting Body]

Figure 10:
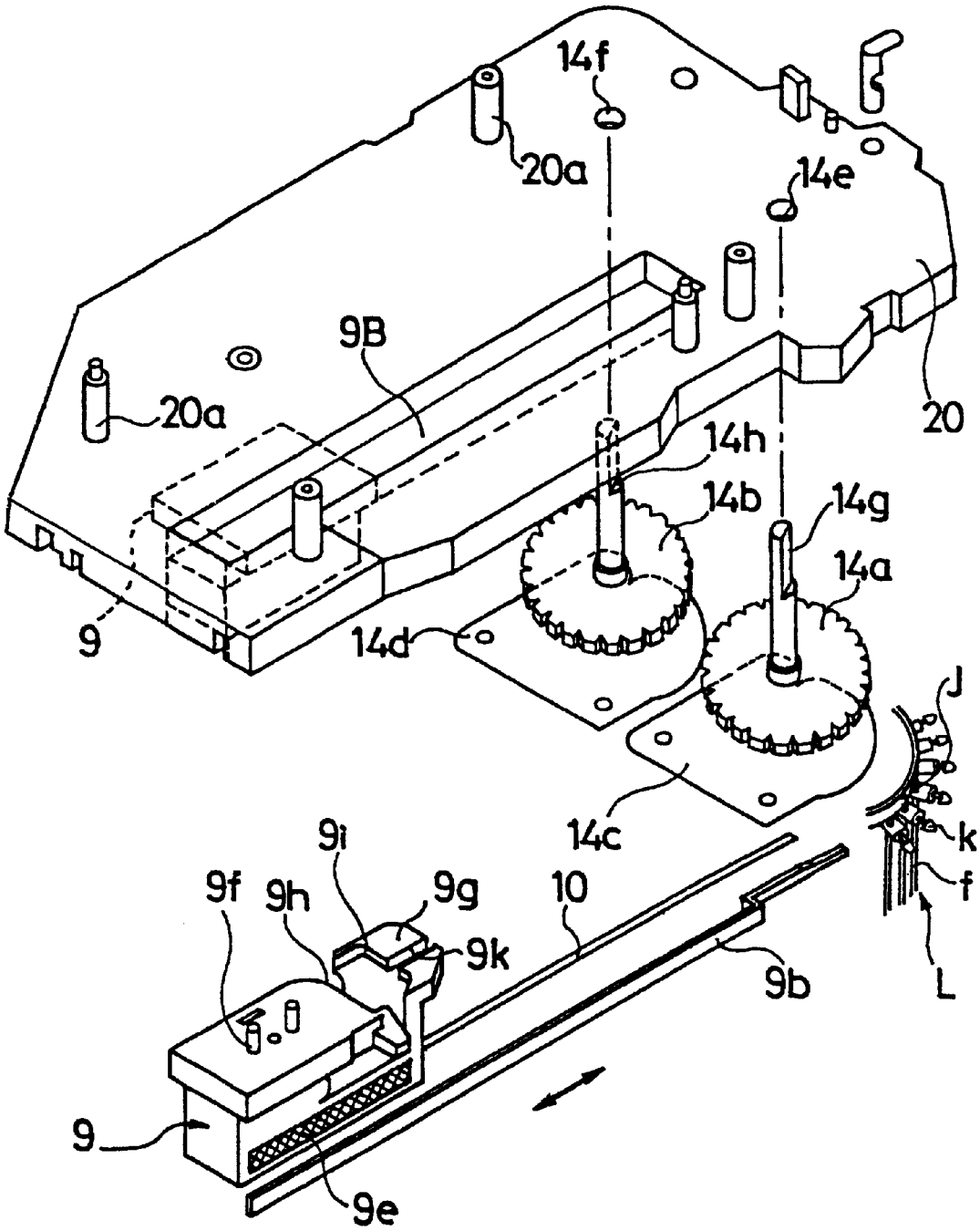
FIG. 10 is a perspective view showing parts associated with a piston, a head feed gear and a joining part feed gear.

FIG. 10 shows parts laminated on the righthand body 2*a* shown in FIG. 6, and a joining part support member 9*b* (a member for precisely maintaining a posture of a joining part k) is arranged in a manner to be guided by one side of the piston guide groove 9A formed on the righthand body 2*a,* a tip end of the joining part support member being fitted into a guide groove 9*c* to be guided, and being stopped by a stopper 9*d* at the last step of movement. In addition, the joining part support member 9*b* is moved back and forth due to frictional forces between it and a rubber plate 9*e* provided on a side of the piston 9.

The first base plate 20 shown in FIG. 10 is overlapped on the righthand body 2*a* shown in FIG. 6 as if it were a lid, and a shaft 14*g* of the joining part feed gear 14*a* is fitted into a bearing hole 14*e* opened to the first base plate 20 to be supported thereby, a shaft 14*h* of the head feed gear 14*b* being fitted into a separate bearing hole 14*f* to be supported thereby. Also, guide plates 14*c,* 14*d* made of thin metallic sheet are arranged along the gears 14*a,* 14*b,* whereby root portions of the filament parts f are made to go around to be guided.

In addition, although not shown in details, in a state shown in FIG. 10, the flexible members J, J are disposed on upper surfaces of the gears 14*a,* 14*b* as shown in FIG. 26, the connecting parts c engage with the gears 14*a,* 14*b,* the heads h or the joining parts k are disposed on undersides of the guide plates 14*c,* 14*d* shown in FIG. 10, and further the filament parts f are extended below the heads h and the joining parts k.

A piston guide groove 9B is opened to a position in a lengthwise direction of the first base plate 20 to be opposed to the piston guide groove 9A shown in FIG. 6, the rod 10 is inserted into the piston guide groove 9B from above to be positioned on a back side of the first base plate 20, and a reduced portion of the piston 9 is fitted into the piston guide groove as shown in dotted lines to become capable of reciprocating.

Further, a suitable number of spacers 20*a* for supporting the second base plate 22 described later are provided upright in suitable positions on an upper surface of the first base plate 20.

[Drive Mechanism for the Head Conveying Arm]

Figure 11:
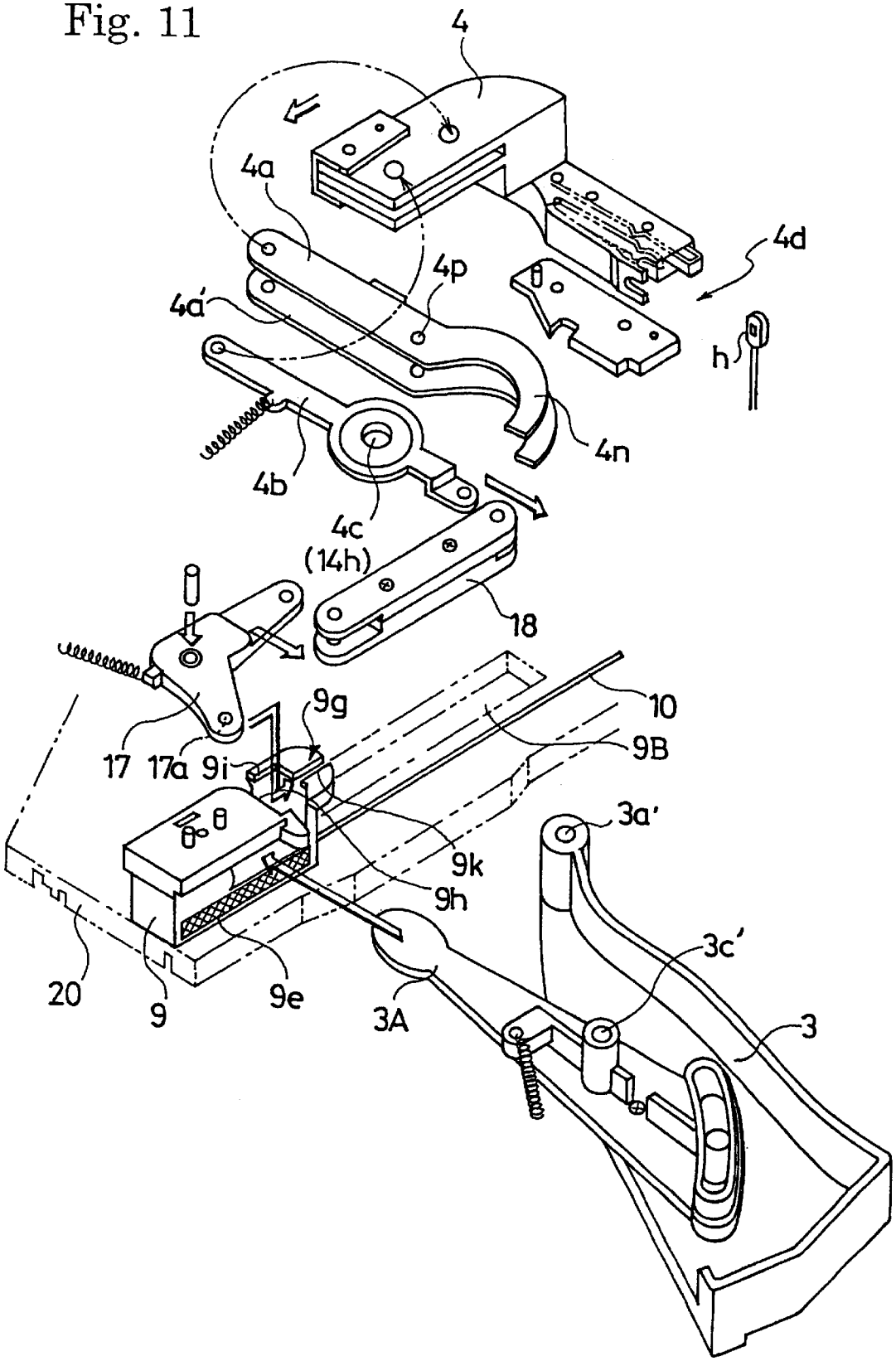
FIG. 11 is a perspective view showing in an exploded state a linkage extending from the lever to a head conveying arm.

FIG. 11 shows, in an exploded view, parts constituting a mechanism disposed between the first base plate 20 and the second base plate 22 (FIGS. 9 and 12) for permitting the piston 9 to move the head conveying arm 4 along a bundling path in the device.

Figure 21:
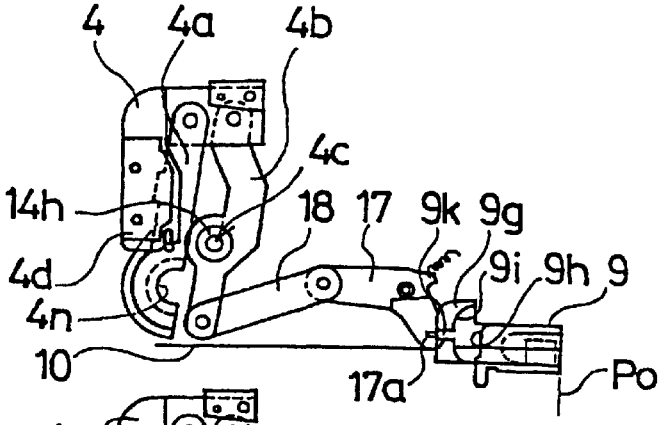
FIG. 21 is a view illustrating a head conveying arm and a linkage for driving the same.

A lever actuating part 9*g* described later is formed at a tip end of the piston 9, and FIG. 11 shows a first L-shaped link 17, as shown in FIG. 21, disposed on the part in an overlapping manner. A projection 17*a* provided projectingly on a side of the first L-shaped link 17 contacts with an advancement cam face 9*h* to turn while being guided thereby, and slidingly contacts with a retreat cam face 9*i* at the time of returning motion of the piston 9 to be guided and driven, and finally is fitted into a groove portion 9*k*, thus terminating engagement with the retreat cam face 9*i*.

An end of the first L-shaped link 17 is inserted into a bifurcated portion of a second link 18 to be connected thereto by a pin as shown in FIGS. 8 and 21, a lower end of a third link 4*b* is fixed to a tip end of the second link 18 by a pin, and the shaft 14*h* of the head feed gear 14*b* (FIG. 10) is fitted into a hole 4*c* provided in the middle of the second link as shown in FIGS. 21 and 11 to support the third link 4*b* in a manner to enable the same swinging back and forth.

A horizontal portion of the head conveying arm 4 is fixed to a pair of fourth links 4*a*, 4*a*′arranged in parallel to the third link 4*b* and to an end of the third link 4*b* by pins. The third link 4*b*, the pair of fourth links 4*a*, 4*a*′and the head conveying arm 4 pivotally mounted to these links constitute "four rod parallel linkage". Further, movements of a series of linkages including the piston 9, the first link 17, the second link 18 and the parallel linkage cause the head conveying arm 4 to move along a predetermined connection path described later.

Concretely, the shaft 14*h* of the head feed gear 14*b* (FIG. 10) is fitted into the hole 4*c* of the third link 4*b* as shown in FIG. 11, pins are inserted through holes 4*p* of the pair of fourth links 4*a*, 4*a*′to be made upright on the first base plate 20, and further upper ends of the third link 4*b* and of the fourth links 4*a*, 4*a*′are fitted into a groove of the head conveying arm 4 to be fixed thereto by pins to constitute the "four rod parallel linkage".

Figure 24:
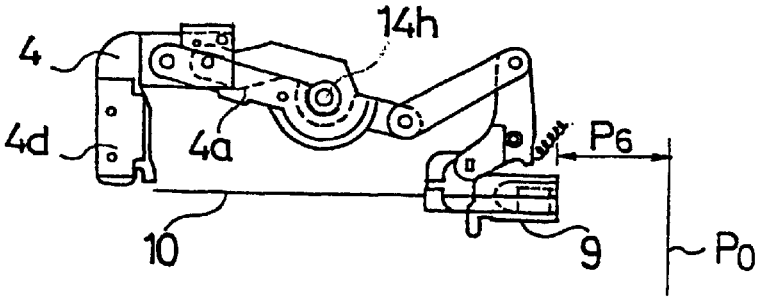
FIG. 24 is a view illustrating a state of movement of the head conveying arm and of the linkage for driving the same.
Figure 25:
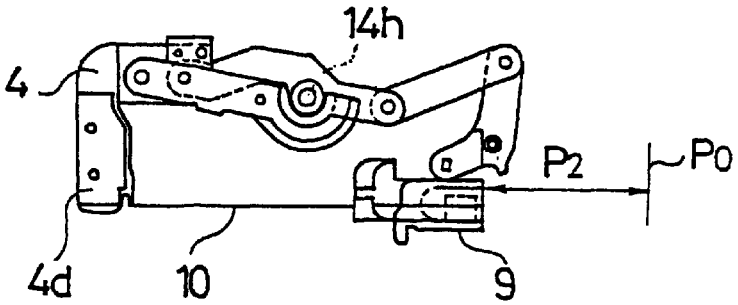
FIG. 25 is a view illustrating a state of movement of the head conveying arm and of the linkage for driving the same.

Arcuate portions 4*n* are formed on lower halves of the fourth links 4*a*, 4*a*′, and the arcuate portion 4*n* formed on the fourth link 4*a* is adapted to abut against the shaft 14*h* to latch the fourth links 4*a*, 4*a*′. As described later with reference to FIGS. 21 to 25, when the linkage moves to change its posture, the fourth links 4*a*, 4*a*′turn as shown in FIGS. 24 to 25 to make the fourth link 4*a* abut against the shaft 14*h*, thereby causing the hole b of the head h supported by the head conveying arm 4 to align with an axis of the hollow needle 5.

Although being not shown, a buffer material composed of rubber is provided around the shaft 14*h*, against which the arcuate portion 4*n* of the fourth link 4*a* abuts, so as to cushion the fourth link 4*a* in such abutting state to stop movements of the head conveying arm 4. In addition, a similar effect can be provided in the case where a buffer material is provided on a side of the fourth link 4*a*.

Figure 33:
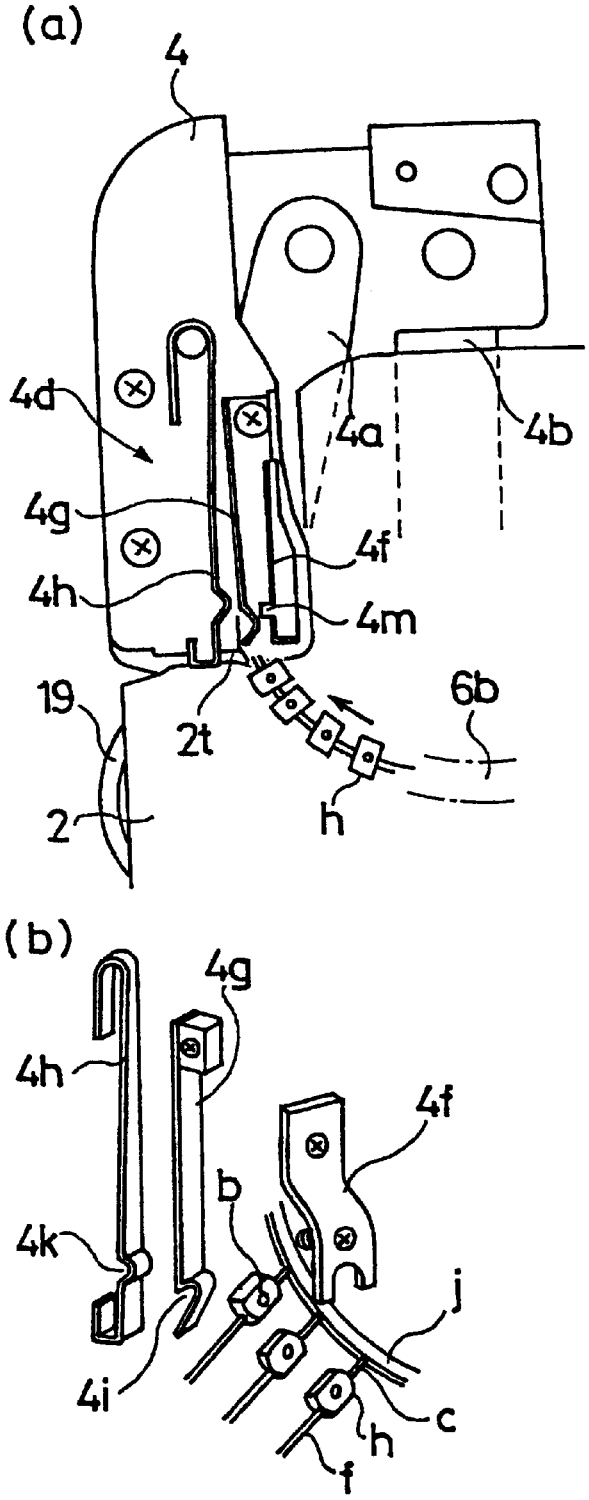
FIG. 33(*a*) is a side view showing an essential part of a head support part, (*b*) being an exploded view showing main parts of the head support part.
Figure 34:
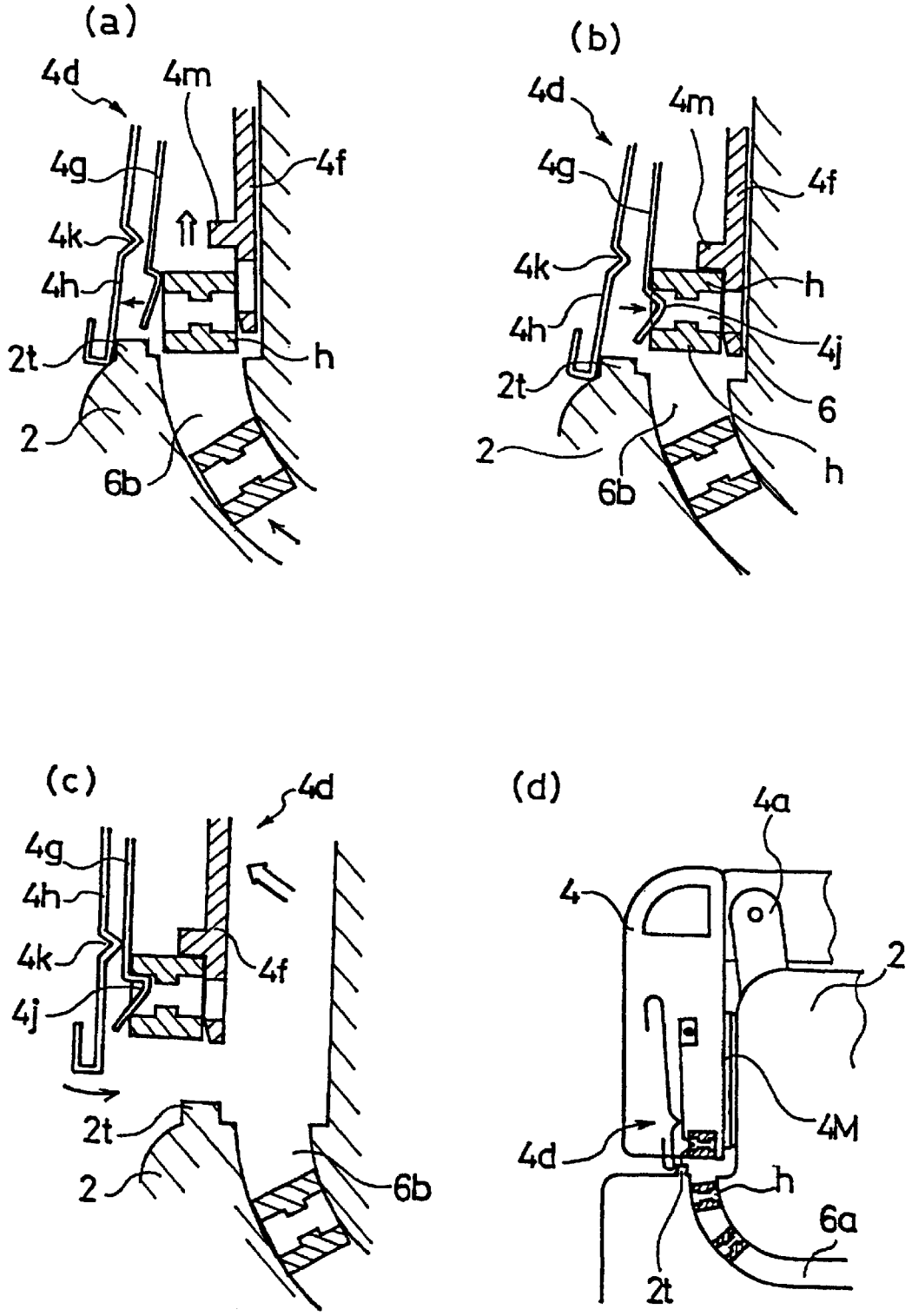
FIGS. 34(*a*), (*b*) and (*c*) are side cross sectional views showing an essential part and a state, in which the head support part holds a head h, (*d*) being a side view showing a stoppage mechanism for the head support part.

Further, a head support part 4*d*, details of which are shown in FIGS. 33 and 34, is provided on a forward end of the head conveying arm 4, and has a head h fitted thereonto to elastically grasp the same by means of elastic forces of parts, which constitute the head support part 4*d* to convey the same to a forward portion of the hollow needle 5 as shown in FIG. 8.

[Feed Mechanism for Connecting Bodies]

Figure 12:
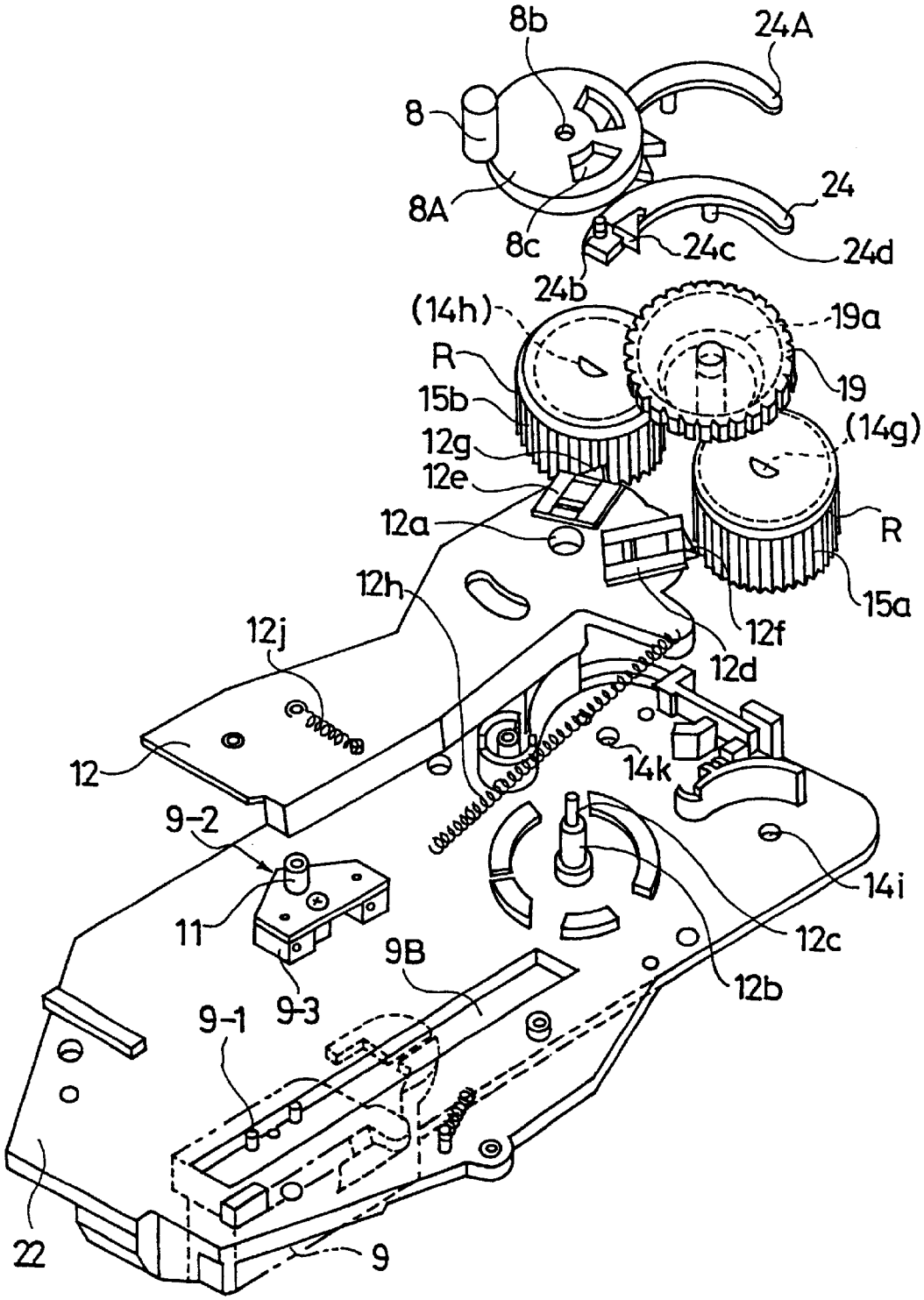
FIG. 12 is a perspective view showing in an exploded state a gear feed lever and parts associated therewith.

FIG. 12 shows a feed mechanism for filament-shaped connecting bodies L, the mechanism being formed between the second base plate 22, which is disposed above and overlapped on the drive mechanism for the head conveying arm 4 shown in FIG. 11, and the lefthand body 2*b* (FIG. 9). A shaft 12*b* provided projectingly on a surface of the second base plate 22 to serve as a spacer is fitted into a hole 12*a* of a gear feed lever 12 to support the same in a swingable manner.

Figure 13:
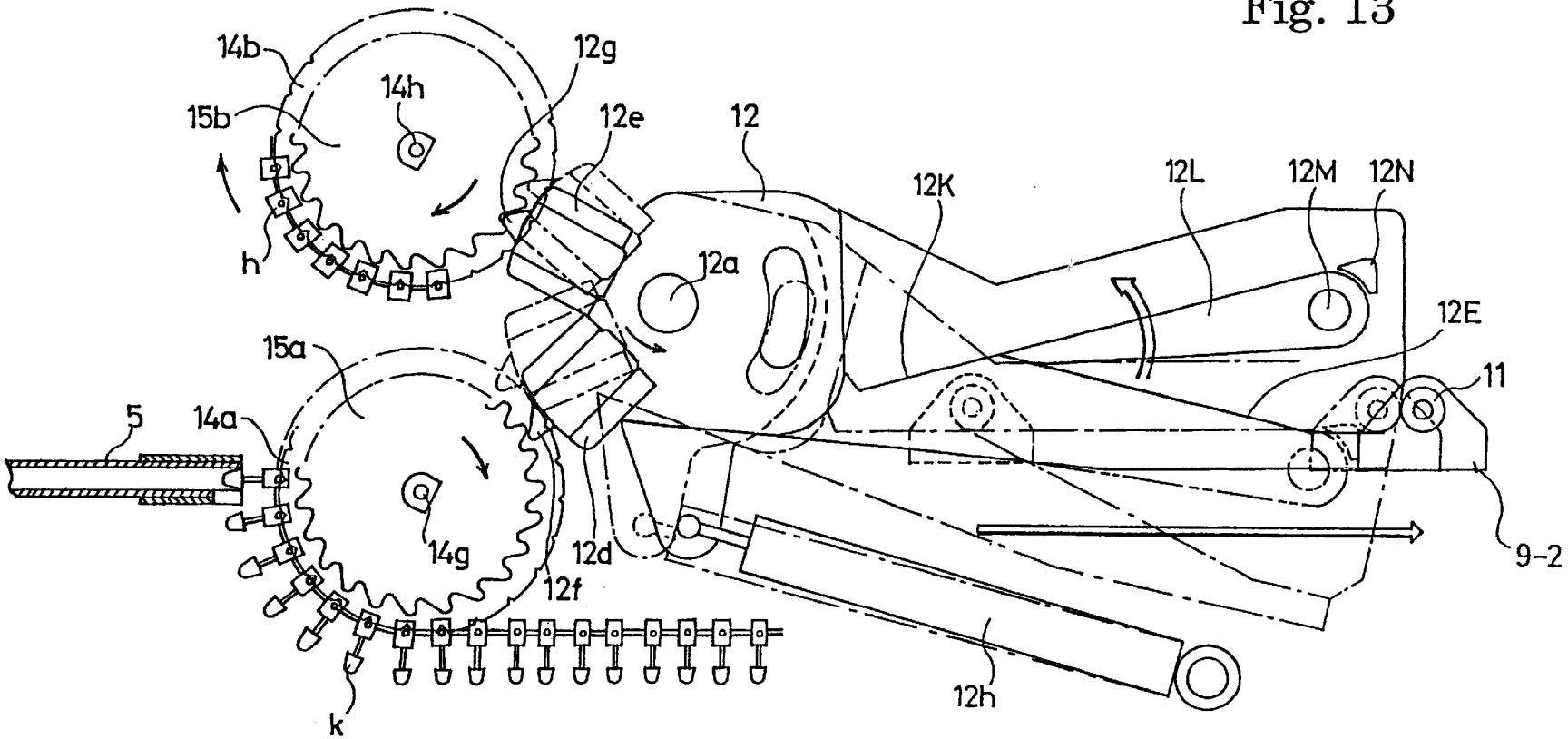
FIG. 13 is a view showing a relationship between the gear feed lever and ratchet wheels.

A projection 9-1 provided on a side of the piston 9 is fitted into a hole 9-3 of an actuating part support body 9-2 to be fixed thereto by a screw, and a cylindrical-shaped actuating part 11 provided projectingly on the actuating part support body 9-2 is made to abut against a guide surface, described later, of the gear feed lever 12 to swing the lever as shown in FIG. 13. In addition, in the case of the actuating part 11 being constituted by a roller, it can be made to act in the same manner as a cam roller.

Figure 14:
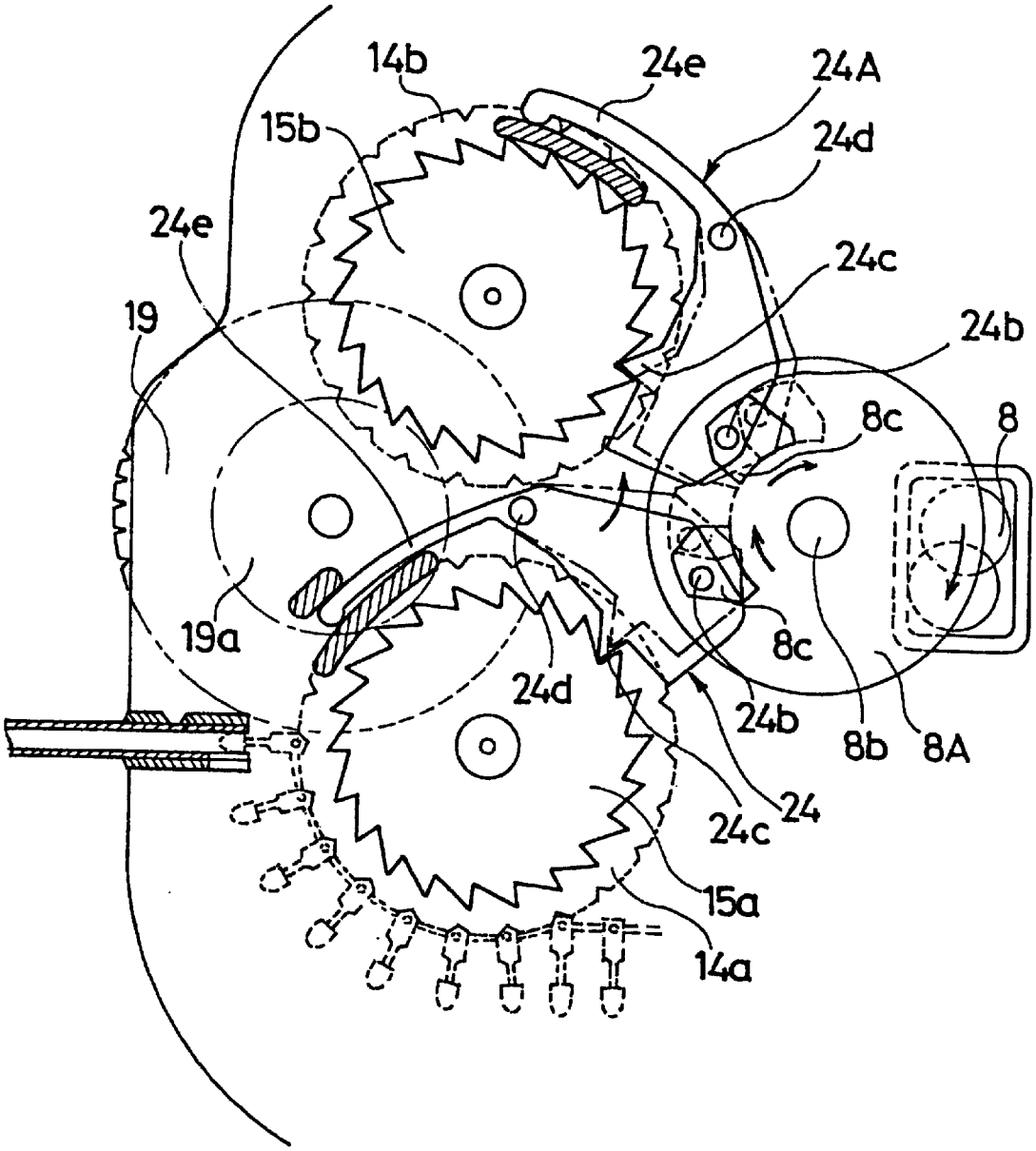
FIG. 14 is a view showing a relationship between the ratchet wheels and stoppers.

A tip end of the lever 12 is bifurcated to form pawl support parts 12*d*, 12*e*, and feed pawls 12*f*, 12*g* provided on the pawl support parts 12*d*, 12*e* are made to engage with ratchet wheels 15*a*, 15*b*, respectively. In addition, the feed pawls 12*f*, 12*g* are made by springs (not shown) to project to engage with the ratchet wheels 15*a*, 15*b*, as shown in FIG. 13, and are made to interlock with stoppers 24, 24A, described later, to disengage from the wheels when the stoppers 24, 24A are released (FIG. 14).

The ratchet wheels 15*a*, 15*b* are fitted onto a semilunar-shaped portion of a tip end of the shaft 14*g* of the joining part feed gear 14*a* and onto a semilunar-shaped portion of the shaft 14*h* of the head feed gear 14*b*, respectively, shown in FIGS. 10, 12 and 13. Although being not shown, one side surfaces of the ratchet wheels 15*a*, 15*b* are formed with grooves of U-shaped cross section, into which rubber bands R (FIG. 12), respectively, are fitted and fixed, so that the wheels can be driven by frictional forces.

The manual feed roller 19 is arranged midway between the ratchet wheels 15*a*, 15*b*, as shown in FIGS. 12 and 1, and a rubber disk 19*a* having a small diameter is provided on a back surface of the roller 19 to contact with the rubber bands R provided on the ratchet wheels 15*a*, 15*b*, so that rotating the roller 19 with a finger tip causes the ratchet wheels 15*a*, 15*b* to be rotated sequentially to enable advancing or retreating a collecting body composed of the connecting bodies L.

As described above, according to the invention, the lever 3 adapted to appear in front of and disappear from the grip part 2*c* due to elastic forces of the spring 3*d* is grasped to cause the piston 9 with the rod 10 to advance performing an action at a forward portion of the hollow needle 5, by which the joining part k is forced into the hole b of the head h of the connecting body L. In the first half step of the grasping operation of the lever 3, the gear feed lever 12 is turned in such a manner that a forward portion thereof is raised, and when the lever is returned to its original position, elastic energy (tensile force) is stored in a spring 12*h*, which performs a feeding action for conveying a collecting body composed of the connecting bodies L.

Further, in the second half step of the grasping operation of the lever 3, the head h is operatively connected to the joining part k. Then at the terminal end of the opening motion of the lever 3, the gear feed lever 12 is returned to its original position at a stretch by elastic energy stored in the spring 12*h*, whereby a collecting body composed of the connecting bodies L is caused to advance by one pitch.

More specifically, in the first half step of the grasping operation of the lever 3, the gear feed lever 12 is made oblique, and an elastic force is correspondingly stored in the spring 12*h* connected to the gear feed lever 12, and in the second half step of the grasping operation the rod 10 provided in the piston 9 pushes and advances the joining part k to connect the same with the head h, which has stood by immediately before the hollow needle 5.

The invention has a feature in preserving the elastic force of the spring 12*h* as it is at the time of the connecting operation, and thereby using a grasping force of the gripping operation of the lever 3 only for connection, during which the gripping force is not increased, so that connection can be smoothly attained in a light operation.

Figure 29:
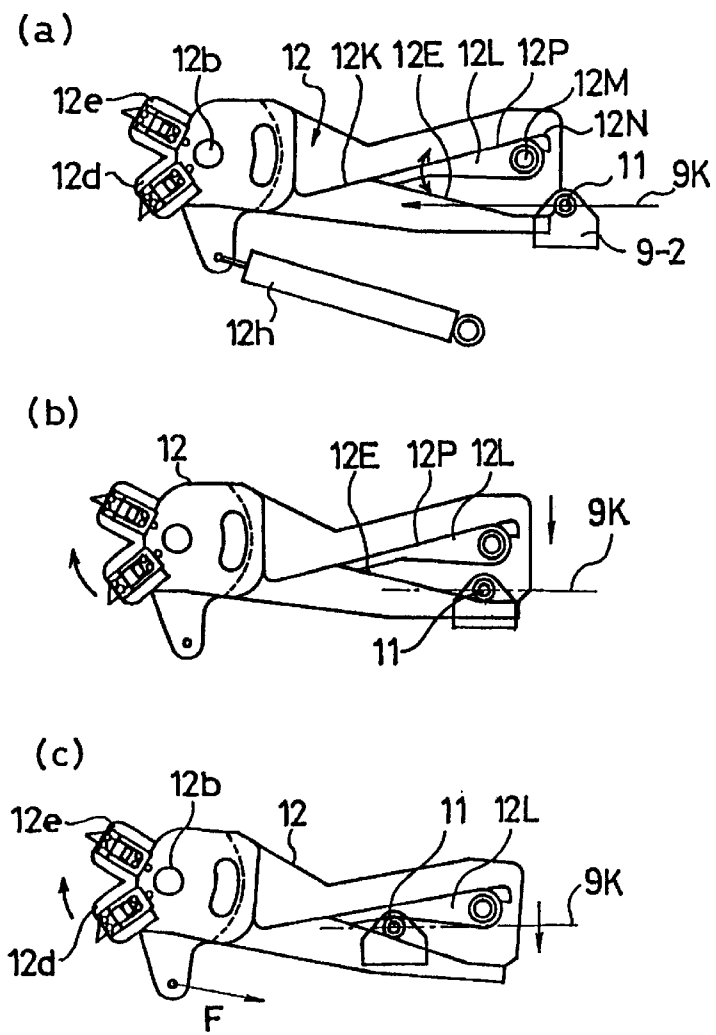
FIG. 29 are side views illustrating an action of a gear feed lever, (a) showing a fundamental position of the gear feed lever, (b) showing a state immediately before the lever is inclined, and (c) showing a state, in which the lever is inclined to stretch and extend a spring.

FIG. 29(*a*) shows that the gear feed lever 12 in a state, in which the lever 3 is not grasped, is located at "reference position". In this position, the piston 9, the actuating part support body 9-2 (FIG. 12) and the actuating part 11 provided on the body are returned to a predetermined retreat position. The actuating part 11 reciprocates linearly along a reference line 9K in parallel to a path, along which the piston 9 reciprocates.

The gear feed lever 12 is formed with a cam surface having a "doglegged configuration", the cam surface being formed with a guide surface 12E, by which a rear portion of the gear feed lever 12 is pushed down to be turned downward so as to stretch the spring 12*h* to store elastic energy therein, and a guide surface 12K, which acts to force the joining part k into the hole b of the head h of the connecting body L in a state, in which the stored elastic energy is preserved as it is.

A guide body 12L is turnably supported on an extension of the guide surface 12K by a shaft 12M, and a discharge piece 12N is formed on the gear feed lever 12 in the vicinity of the shaft 12M. The guide body 12L is caused by a spring 12J to have its tip end brought into pressing contact with a tip end of the guide surface 12E, and turns up and down as shown in an arrow.

As shown in FIG. 29(*a*), the guide surface 12E and a guide surface 12P of the guide body 12L assume a V-shape, and the guide surface 12K is aligned linearly with a guide surface 12P of the guide body 12L, these three guide surfaces 12E, 12K and 12P assuming a substantially Y-shape.

The actuating part support body 9-2 (FIG. 12 corresponds to FIG. 29) starts on the reference line 9K as shown by an arrow in FIG. 29(*a*) upon the grasping operation of the lever 3, is positioned at a starting point of the guide surface 12E in FIG. 29(*b*) (allowance is given to movements of parts including the lever 3 in an interval between positions in FIG. 29(*a*) and FIG. 29(*b*)), advances pressing the guide surface 12E in FIG. 29(*c*) to push down the rear portion of the gear feed lever 12 about the shaft 12*b* as shown by an arrow to lift forwardly extending pawl support parts 12*d*, 12*e* as shown by an arrow. Such inclination of the gear feed lever 12 constitutes a preparatory stage for feeding a collecting body composed of the connecting bodies L by one, that is, one pitch, and in this stage the spring 12*h* is pulled to be gradually increased in an elastic force F generated.

Figure 30:
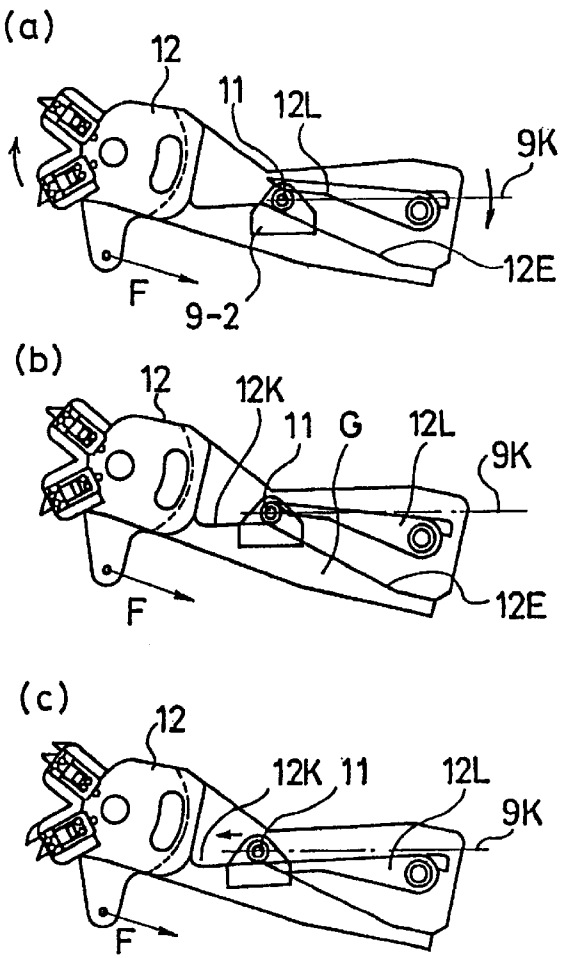
FIG. 30 are side views illustrating an action of the gear feed lever, (a) showing a position of the lever immediately before it is inclined at its maximum, (b) showing a position of the lever when it is inclined at its maximum, and (c) showing a position where the connecting operation of a connecting body is started.

FIGS. 30(*a*) to 30(*b*) show a state, in which the actuating part 11 moves around a terminal end of the guide surface 12E pushing up the guide body 12L while elastic energy F required to feed a collecting body composed of the connecting bodies L is stored in the spring 12*h*.

FIG. 30(*c*) shows a starting point of an interval, in which the connecting operation (fitting) of a filament-shaped connecting body L is performed, and the actuating part 11 is positioned at a starting point of the guide surface 12K. In this state, the guide surface 12K and the guide surface 12P of the guide body 12L make a straight line, and are in parallel to the reference line 9K.

Figure 31:
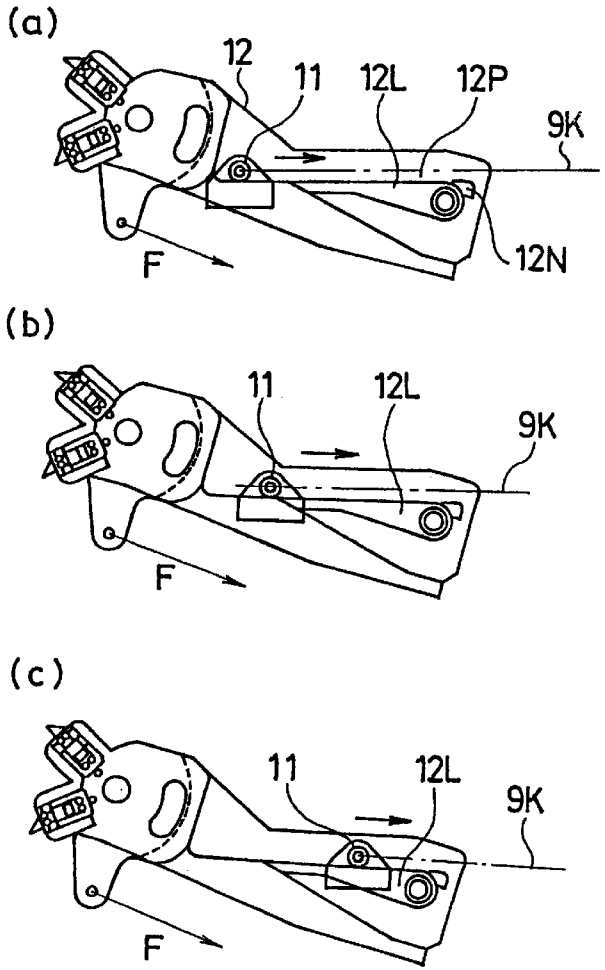
FIG. 31 are side views illustrating an action of the gear feed lever, (a) showing a position where the connecting operation terminates, and (b) and (c), respectively, showing a state, in which an actuating part moves on a guide surface while the gear feed lever is kept in a reference position.

From the state in FIG. 30(*c*), the actuating part 11 moves on the guide surface 12K as shown by an arrow, and comes to a state shown in FIG. 31(*a*), at which the joining part k is fitted into the head h for termination of connection of the connecting body L and so the filament part f makes a ring-shape.

Figure 32:
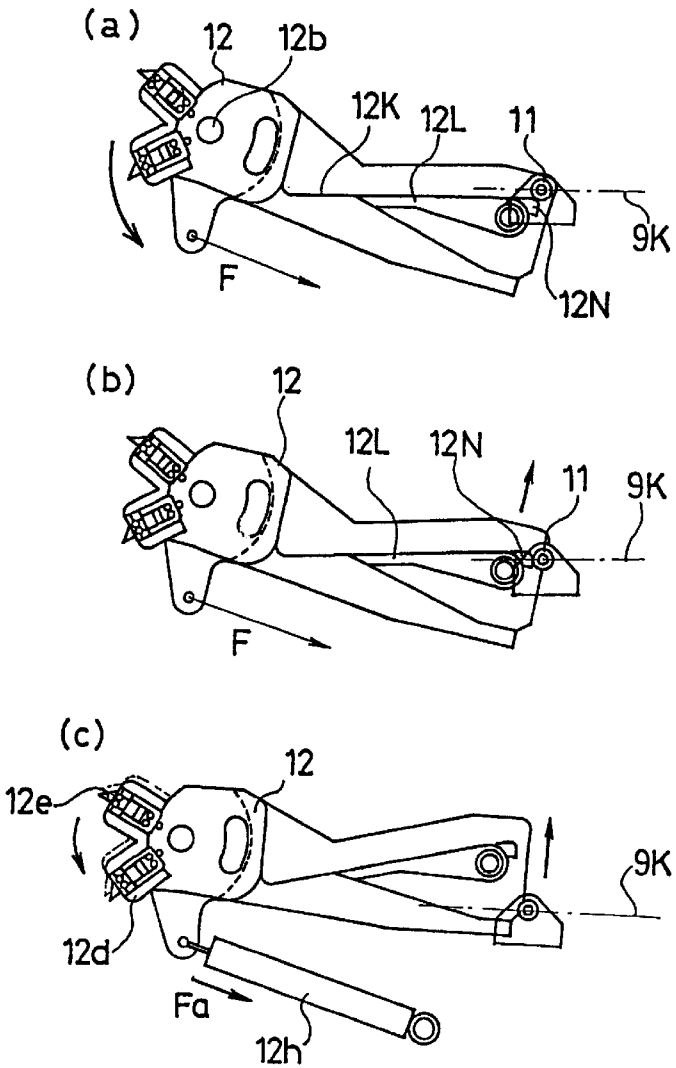
FIG. 32 are side views illustrating an action of the gear feed lever, (a) showing a state, in which the actuating part moves to a terminal end of the guide surface, (b) showing a state, in which the actuating part gets out of the guide surface, and (c) showing a state, in which the gear feed lever returns to its original position and a connecting body is fed to the next striking position.

When connecting action of a single connecting body L is terminated as described above, the grasping force on the lever 3 is released. Upon releasing of the lever 3, the actuating part 11 retreats on the guide surface 12P of the guide body 12L as shown by an arrow in FIG. 31(*c*) via a state shown in FIGS. 31(*a*) to 31(*b*), and rides on the discharge piece 12N at a terminal end of the guide surface 12P of the guide body 12L as shown in FIG. 32(*a*), immediately after which the actuating part automatically disengages therefrom to instantaneously come to a state shown in FIG. 32(*b*). The elastic force F stored in the spring 12*h* is preserved as it is in an interval between states shown in FIGS. 31(*a*) to FIG. 32(*a*) inclusive, and in such interval the gear feed lever 12 is also kept in posture aligned with the reference line 9K.

When it comes to FIG. 32(*b*) from FIG. 32(*a*), the actuating part 11 disengages from the discharge piece 12N to make the gear feed lever 12 free to thereby release the elastic force stored in the spring 12*h*. As shown in FIGS. 32(*a*) to 32(*c*), in such state, in which the elastic force F is released, the gear feed lever 12 is made such that a rear portion thereof provided with the guide body 12L rises about the shaft 12*b* as shown by an arrow, and the pawl support parts 12*d*, 12*e* at the tip end thereof descend to rotate the feed pawls 12*f*, 12*g* provided on the pawl support parts 12*d*, 12*e* a predetermined angle as shown in FIG. 13, thus intermittently rotating the joining part feed gear 14*a* and the head feed gear 14*b*, respectively, which are provided adjacent to the feed pawls 12*f*, 12*g*, one pitch (an angle, at which a single filament-shaped connecting body L is fed).

Stated repetitively, the spring 12*h* is elongated to store the elastic force F in an interval between states shown in FIGS. 29(*a*) to FIG. 30(*c*) inclusive, and in such interval an elastic force F, that is, energy for feeding of a filament-shaped connecting body L being subsequently connected is stored in the spring 12*h* while the lever 3 is operatively grasped to perform connection of the connecting body L.

FIGS. 30(*c*) to 31(*a*) show an interval for connecting operation of a connecting body L, in which interval the guide surface 12K and the reference line 9K are positioned in parallel to each other, and the gear feed lever 12 is held in posture as it is to cause no change in length of the spring 12*h*, so that the elastic force F stored in the spring 12*h* is preserved as it is. Accordingly, because a force to grasp the lever 3 is used exclusively for connecting operation of a connecting body L, the connecting operation can be smoothly performed.

FIGS. 31(*a*) to 32(*a*) show a state, in which a force to grasp the lever 3 is released to allow the piston 9 to return to its original position, and in which the actuating part 11 moves along the reference line 9K, so that the elastic force F stored in the spring 12*h* is preserved as it is.

FIGS. 32(*b*) to 32(*c*) show a state, in which a collecting body composed of the connecting bodies L is fed one unit, that is, the head h and the joining part k are fed to a location where a subsequent connecting operation is to be performed, and in which the elastic force F stored in the spring 12*h* is released as Fa to return the gear feed lever 12 to a position shown in FIG. 32(*c*) or FIG. 29(*a*).

[Mechanism for Taking Out a Connecting Body L]

Subsequently, a mechanism for taking out a collecting body composed of the filament-shaped connecting bodies L having been fed to the mount device 1 will be explained.

As shown in FIGS. 12 and 14, a stopper release body 8A provided the release knob 8 (FIG. 5) is supported with its central hole 8*b* fitted onto a portion of a shaft 12*c,* which is formed on an extension end of the shaft 12*b* pivotally supporting the gear feed lever 12.

Projections 24*b* formed on sides of the stoppers 24, 24A are made to be inserted into engagement holes 8*c* opened in the stopper release body 8A, and the release knob 8 is operatively pulled down as shown by an arrow in FIG. 14 whereby the stoppers 24, 24A are caused by the projections 24*b* to retreat so that latch pawls 24*c* having meshed with the ratchet wheels 15*a,* 15*b* by the use of elastic forces of spring portions 24*e* are retreated to release engagement of the ratchet wheels 15*a,* 15*b* and the stoppers 24, 24A, thus enabling the joining part feed gear 14*a* and the head feed gear 14*b* to freely rotate.

The stoppers 24, 24A are provided centrally thereof with projections 24*d,* which are fitted into bearings provided on the second base plate 22 (FIGS. 9 and 12), portions, which are disposed on one sides of the projections 24*d* to constitute extensions of the spring portions 24*e* to contact with hatched, stationary parts (projecting from an inner surface of the lefthand body 2*b*) as shown in FIG. 14, and portions, which are formed on the other sides of the projections 24*d* to have the latch pawls 24*c* and the projections 24*b* for engagement with the stopper release body 8A.

Also, FIG. 13 shows a state, in which the joining part k and the head h, which engage with the joining part feed gear 14*a* and the head feed gear 14*b,* respectively, are sequentially fed to predetermined positions by the swinging operation of the gear feed lever 12 accompanied by reciprocation of the piston 9, that is, by rotating by one pitch the ratchet wheels 15*a,* 15*b* provided adjacent to and coaxially with the joining part feed gear 14*a* and the head feed gear 14*b,* as described with reference to FIGS. 21 to 25 and FIGS. 29 to 32. In addition, this state is easy to understand with reference to FIG. 26.

[Operating State of Piston 9 and First Link 17]

Figures 15, 16, 17, 18, 19, 20:
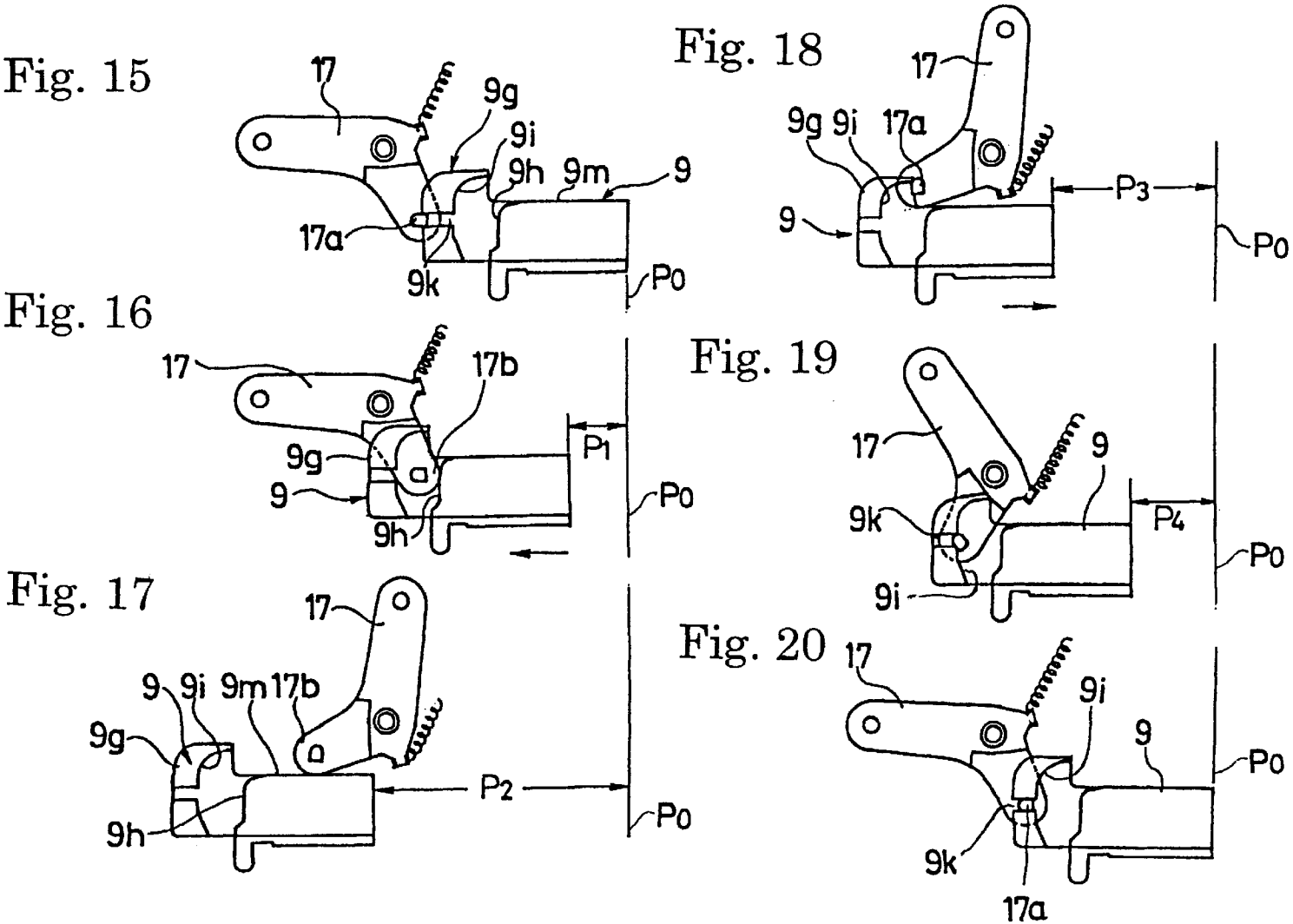
FIG. 15 is a view illustrating a relationship of movement between the piston and a first link.
FIG. 16 is a view illustrating a relationship of movement between the piston and the first link.
FIG. 17 is a view illustrating a relationship of movement between the piston and the first link.
FIG. 18 is a view illustrating a relationship of movement between the piston and the first link.
FIG. 19 is a view illustrating a relationship of movement between the piston and the first link.
FIG. 20 is a view illustrating a relationship of movement between the piston and the first link.

As shown in FIGS. 11, 15 and 21, the lever actuating part 9*g* is formed at a front of the piston 9, and is formed with an advancement cam surface 9*h,* a retreat cam surface 9*i* and a groove 9*k,* which is formed laterally middle of the retreat cam surface 9*i,* and into which the projection 17*a* provided on the first link 17 is fitted.

FIG. 15 shows a state, in which the piston 9 is in a start position $P_0$ before the lever 3 is grasped, and which corresponds to that in FIG. 7, the projection 17*a* of the first link 17 being fitted into the groove 9*k.*

FIG. 16 shows a state, in which the lever 3 begins to be grasped, and the piston 9 advances to a position $P_1$ as shown by an arrow immediately before the drive mechanism for the head conveying arm 4 starts action, in which position an engagement 17*b* on the first link 17 abuts against the advancement cam surface 9*h* formed on the piston 9.

Further, FIG. 17 corresponds to FIG. 8, and shows a state, in which the piston 9 advances to a position $P_2$ whereby the joining part k fits into the hole b of the head h of the connecting body L at a terminal end of advancement of the head conveying arm 4 to make the filament part f ring-shaped, and in which the engagement 17*b* on the first link 17 abuts against a non-actuating surface 9*m* of the piston 9.

In addition, while the engagement 17*b* abuts against a non-actuating surface 9*m* of the piston 9, the head conveying arm 4 advances and mores, as shown in FIG. 8 (see FIGS. 21 to 25), immediately in front of the hollow needle 5 to force into the hollow needle 5 a rod 10 mounted to the piston 9.

And, FIG. 18 shows a state, in which grasping of the lever 3 is released, and the piston 9 retreats from the position shown in FIG. 17 to a position $P_3$ immediately after the projection 17*a* of the first link 17 abuts against the retreat cam surface 9*i* on the lever actuating part 9*g* of the piston 9.

A distance ($P_2$–$P_3$) between the positions $P_2$ and $P_3$ in FIGS. 17 and 18, respectively, defines a so-called "buffer zone" where even when grasping of the lever 3 is released to allow the piston 9 to retreat, the first link 17 does not begin turning and hence the linkage does not begin returning action. The presence of such buffer zone eliminates excessive forces on the linkage to thereby permit smooth retreating movement of the head conveying arm 4. In addition, it goes without saying that the rod 10 retreats simultaneously with retreat of the piston 9.

FIG. 19 shows a state, in which the piston 9 retreats to a position $P_4$ from the position $P_3$ shown in FIG. 18 immediately before the projection 17*a* of the first link 17 slides down the retreat cam surface 9*i* to fit into the groove 9*k* formed laterally.

Immediately after such state, the projection 17*a* fits into the groove 9*k* and the piston 9 returns to the initial position $P_0$ as shown in FIG. 20, and the first link 17 is rendered horizontal shown in FIG. 15, and this state shifts to connecting operation of a connecting body L described with reference to FIGS. 15 to 17.

[Actuating Condition of the Linkage for Conveying the Head Conveying Arm 4]

(State Before the Start of Connecting Operation)

FIG. 21 corresponds to a state of the mechanism shown in FIG. 15 or FIGS. 20 and 7, in which the projection 17*a* of the first link 17 is positioned in the groove 9*k* in the lever actuating part 9*g* of the piston 9, the first link 17 is rendered horizontal and the third link 4*b* is positioned upright.

The head conveying arm 4 pivotally mounted to upper ends of the third link 4*b* and of the pair of the fourth links 4*a,* 4*a'*is positioned in a location most retreated. In addition, the head h in such location fits into the head support part 4*d* shown in FIG. 11 to support the same.

(Initial Operation)

An operation of bringing the mount device 1 of the invention near goods, to which an indication card is to be mounted, may be performed when the space Q (space shown in FIGS. 4 and 8) between the head conveying arm 4 and the hollow needle 5 is adequately large. Also, by mounting an indication card to the hollow needle 5 prior to the connecting operation of a connecting body L, the mount device 1 can be operated with one hand.

Figure 22:
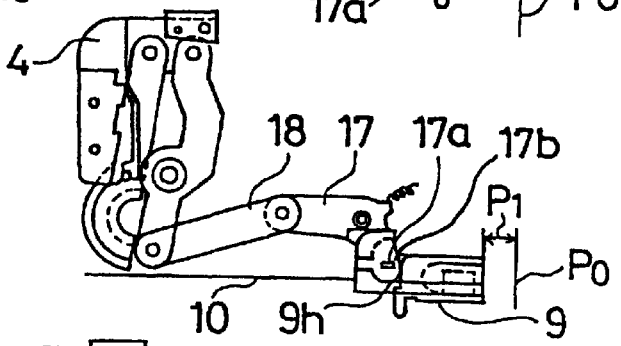
FIG. 22 is a view illustrating a state of movement of the head conveying arm and of the linkage for driving the same.

FIG. 22 corresponds to FIG. 16, and shows a state, in which the engagement 17*b* on the first link 17 abuts against the advancement cam surface 9*h* on the lever actuating part 9*g,* and the piston 9 advances to the position $P_1$.

Figure 23:
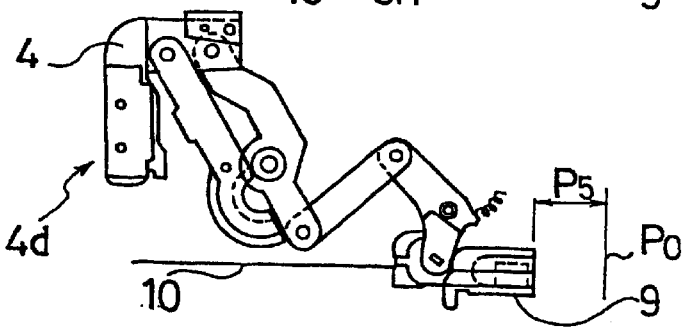
FIG. 23 is a view illustrating a state of movement of the head conveying arm and of the linkage for driving the same.

FIG. 23 shows a state, in which the head conveying arm 4 has moved in front of the rod 10 extended from the tip end of the piston 9, and the piston 9 advances to a position $P_5$ from the initial position $P_0$.

FIG. 24 shows a state, in which the head conveying arm 4 is made to gradually come in front of the rod 10, that is, in front of the hollow needle 5, and the piston 9 advances to a position $P_6$.

FIG. 25 corresponds to FIGS. 17 and 8, and shows a state, in which the piston 9 is in a position $P_2$, and the joining part k having been pushed by the rod 10 to be moved in the hollow needle 5 fits into the hole b of the head h supported in the head support part 4*d* at the tip end of the head conveying arm 4.

[Mechanism on the Head Support Part 4 for Grasping the Head H]

A collecting body composed of the connecting bodies L is inserted into the head grooves 6*b* and the join grooves 6*a,* respectively, which are formed above and below on a side of the body 2 of the mount device 1, as shown in FIGS. 2 and 4 to be fed forward, and connecting parts c of the connecting bodies L are fitted into peripheral grooves on the head feed gear 14*b* and on the joining part feed gear 14*a* as shown in FIG. 26 to go around, are grasped at a central position of a tip end of the gear, which is the foremost portion, by the head support part 4*d* and simultaneously or immediately thereafter are cut by a knife N shown in FIG. 9.

As shown in FIG. 33(*a*) and 33(*b*) being a side view of an essential part and an exploded view of parts, the head support part 4*d* comprises a holding body 4*f* disposed inside of the most forward one of a plurality of successive heads h, which move going around the head feed gear 14*b* while being guided by the head grooves 6*a,* and a first elastic piece 4*g* and a second elastic piece 4*h,* which are disposed double-overlapping outside in opposition to the holding body 4*f*. The first elastic piece 4*g* is provided with a projection 4*j,* which is adapted to be fitted into the hole b of the head h, and the second elastic piece 4*h* is provided with a projection 4*k,* which functions to push a back surface of the first elastic piece 4*g*. Also, the holding body 4*f* is provided with a projection 4*m,* which functions to position the head h.

An action of the head support part 4*d* will be described. As shown in FIGS. 34(*a*) to 34(*c*) being side views, at the end of the lever 3 of the mount device 1 being grasped and released, the head support part 4*d* provided at the tip end (lower end) of the head conveying arm 4, which is caused by the linkage to perform a circular arc movement in front of the body 2, advances to a predetermined path and then returns to make the second elastic piece 4*h* contact with a stop 2*t,* as shown in FIG. 34(*a*), which protrudes laterally of the head groove 6*b* of the body 2.

More specifically, when the head conveying arm 4 retreats to a storage position as shown by chain lines in FIG. 4, the second elastic piece 4*h* evacuates to make an elastic force of the first elastic piece 4*g* render weak. At the end of the returning motion of the head support part 4*d,* a head h (simultaneously, joining part k) being subsequently connected is fed into the head support part 4*d* from below as shown by an arrow in FIGS. 34(*a*) and 34(*b*), and the projection 4*j* on the first elastic piece 4*g* is fitted into one side of the hole b of the head h, as shown in FIG. 34(*b*), so that the head h will be elastically interposed between the holding body 4*f* and the first elastic piece 4*g*.

Subsequently, when the lever 3 is grasped accompanying the connecting operation, the head conveying arm 4 moves in front of the body 2 together with a series of motions of the linkage to come to a state shown in FIG. 34(*c*), and a lower end of the second elastic piece 4*h* separates from a stoppage portion 2*t* formed on the body 2 to permit the projection 4*k* of the second elastic piece 4*h* to push a back surface of the first elastic piece 4*g* to thereby surely hold the head h on the head conveying arm 4. And the head conveying arm moves to a position for connection of the head along a predetermined path of connecting operation.

FIG. 34(*d*) shows a means for surely stopping the head conveying arm 4 in front of the body 2, and comprising a magnet type attracting device 4M provided on a back of the head conveying arm 4 and a front surface of the body 2. The magnet type attracting device 4M is composed of a magnet plate and a metallic plate so that a single head h can be fed to the head support part 4*d* by securing the head conveying arm 4 on a front of the body 2.

Figure 35:
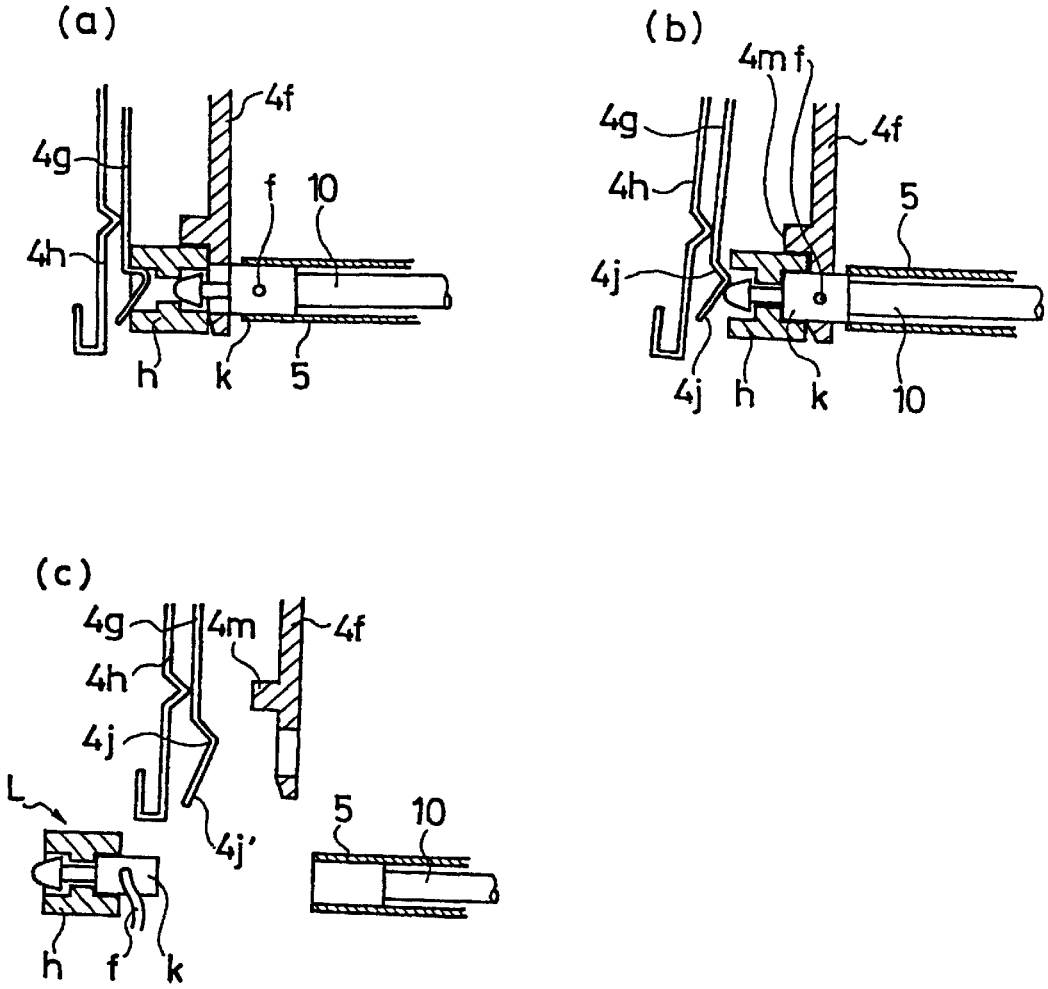
FIGS. 35(*a*), (*b*) and (*c*) are side cross sectional views showing a state, in which the head h and the joining part k are joined to each other.

FIG. 35 shows an operation of connecting adjoining part k to a head h. In FIGS. 26 and 35(*a*), when the lever 3 of the mount device 1 is grasped, the head conveying arm 4 moves in front of the hollow needle 5 along a circular arc path to stand by, although momentarily, with a center of a head h positioned on a center line of the hollow needle 5.

Immediately after that, the rod 10 advances together with the piston 9 to make the joining part feed gear 14*a* push and advance a rear portion of a joining part k having been fed in front of the body 2 to thereby force and fit a tip end of the joining part k into the hole b of the head h, which has stood by at the forward end of the hollow needle 5.

The joining part k is further advanced together with the rod 10 whereby the head h and the joining part k are completely joined as shown in FIG. 35(*b*). In this case, it is to be noted that an inclined surface 4*j*′on the underside of the projection 4*j* formed on a tip end of the first elastic piece 4*g* pushes a flame-shaped portion of the joining part k.

With such arrangement, the head h pushed against and held on the holding body 4*f* by elastic forces of the double-overlapped elastic pieces is simply disengaged when a filament part f encircling a handle of goods, for example, a bag or the like is pulled upon movements of the goods, thus making it possible to efficiently mount an indication card to the goods or connect two or more goods together.

Figure 36:
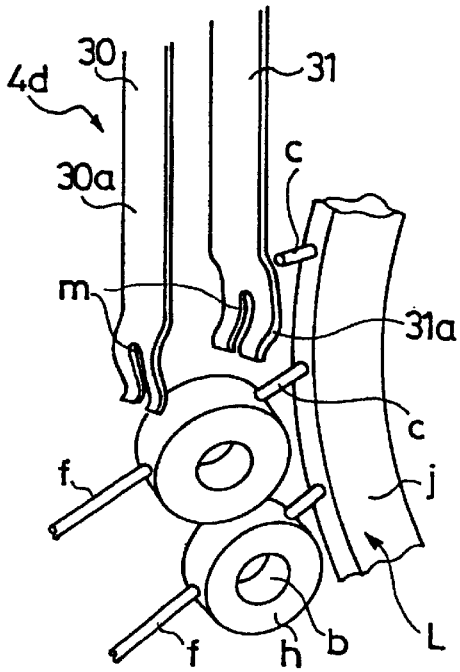
FIG. 36 is a perspective view showing another construction of the head support part.

FIG. 36 is a perspective view showing another type of head support part 4*d* comprising a first elastic piece 30 and a second elastic piece 31 constructed such that upon advancement of a connecting body L a leading single head h is forced between grasping portions 30*a,* 31*a* of the pieces having grooves m at tip ends thereof to be grasped elastically.

Figure 37:
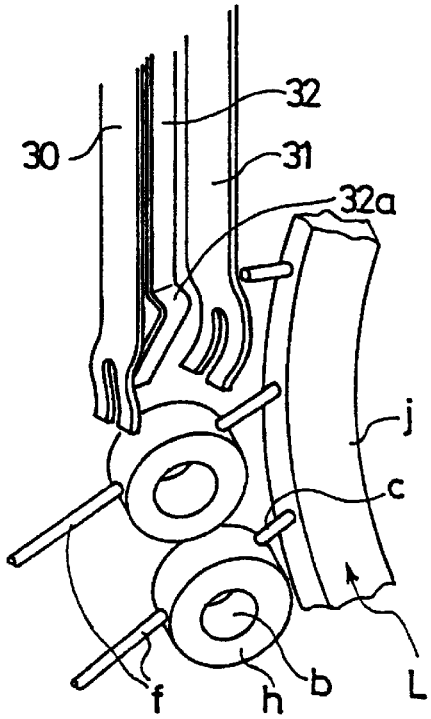
FIG. 37 is a perspective view showing a still further construction of the head support part.

FIG. 37 is a perspective view showing another type of head support part 4*d* comprising a first elastic piece 30, a second elastic piece 31 and a third elastic piece 32 provided between and laterally of the first and second elastic pieces, the third elastic piece 32 being provided at a tip end thereof with a projection 32*a,* which is adapted to fit into a hole b of a head h to position the head.

The mount device I of filament-shaped connecting body L according to the invention can be subjected to connection operation through the movement shown in FIG. 7, FIG. 8, FIGS. 5 to 20, and further, FIGS. 21 to 25.

Heads h of and joining parts k of filament-shaped connecting bodies L together with connecting bands J, J are fed, as shown in FIG. 4*a* and 26, to the head grooves 6*a* and the join grooves 6*b* formed on the side of the body 2 of the mount device 1 to be successively conveyed, as shown in FIG. 13, by the head feed gear 14*b* and the joining part feed gear 14*a* and with operation of the respective members such as the feed lever 12 and so on. The following operation is performed at a tip portion of the body 2 around these gears 14*b,* 14*a*.

At the last of a preceding connecting operation or of an operation of grasping and releasing the lever 3, the head h is held, as shown in FIGS. 34(*a*) to 34(*c*), by the head support part 4*d* at the tip end of the head conveying arm 4, and connecting parts c shown in FIG. 27 are cut by the knife N shown in FIG. 9, the head then being conveyed in front of the discharge port of the hollow needle 5 and made stand by as shown in FIG. 4.

Meanwhile, the joining part k is pushed by the rod 10 as shown in FIGS. 9, 26 and 35(*a*) to 35(*c*), and forced into the hollow needle 5 after the connecting part c shown in FIG. 27 is cut by the knife N shown in FIG. 9, the joining part then being forced and fitted into the hole b of the head h, which has stood-by at the discharge port end of the hollow needle 5, to connect the filament part f in a ring-shaped manner. At this time, the filament part f passes through a hole of an indication card mounted on the hollow needle 5 to mount such indication card to various goods. In a motion of the mount device 1 away from goods, the connecting operation of a filament-shaped connecting body L is completed as shown in FIG. 35(*c*).

Industrial Applicability:

As described above, the invention presents the following effects.

1. In accordance with the method for connection of filament-shaped connecting bodies, according to the invention, a collecting body composed of filament-shaped connecting bodies held between flexible members disposed on both sides thereof is loaded in the mount device, the connecting bodies are separated one by one from the collecting body to be successively fed in front of the mount device, a filament part is made to encircle an arm of, for example, a bag with an indication card inserted through the filament part, the joining part is fitted into the head to achieve efficient connection to enable mounting of the indication card and connection of two or more goods or articles.
2. In accordance with the method for connection of filament-shaped connecting bodies, according to the invention, a single filament-shaped connecting body is separated from a collecting body composed of filament-shaped connecting bodies while the collecting body is made to go around two gears arranged in front of the mount device, a head is made to stand by immediately in front of the hollow needle and simultaneously a joining part is fed from the hollow needle to fit into the head, so that the collecting body composed of connecting bodies is smoothly fed and so can be mounted to goods together with a price tag or the like.
3. In accordance with the mount device for connection of filament-shaped connecting bodies, according to the invention, a collecting body composed of filament-shaped connecting bodies held between flexible members disposed on both sides thereof is loaded on a side of the device, an operation with a lever separates a single filament-shaped connecting body in good order to grasp a head at a tip end of the head conveying arm to convey the same in front of the hollow needle and to project a joining part through the hollow needle to enable engaging the same with the head, so that the filament-shaped connecting body can be simply connected in annular configuration.
4. In accordance with the mount device for connection of filament-shaped connecting bodies, according to the invention, the gear feed lever is inclined in the previous step of the lever grasping operation to store an elastic force in the spring, the connecting operation of a connecting body is performed in the subsequent step, then grasping of the lever is released, and simultaneously the elastic force is made use of to turn the gear feed lever to move the connecting body to a sending position (striking position), so that there is no need of any surplus force for the lever in the connecting operation, and so a worker can be relieved of fatigue in the connecting operation.
5. In accordance with the mount device for connection of filament-shaped connecting bodies, according to the invention, the gear feed lever having a doglegged guide surface and a guide body for engagement with and disengagement from the guide surface is provided, whereby the grasping operation of the lever causes inclination of the gear feed lever, during which an elastic force is stored in the spring, and the connecting operation is effected, after which the elastic force of the spring is made use of to enable continuously and lightly feeding a connecting body.
6. In accordance with the mount device for connection of filament-shaped connecting bodies, according to the invention, a collecting body composed of filament-shaped connecting bodies is fed to a side of the body and the flexible members connecting the collecting body can be smoothly guided to a rear portion of the mount device, so that they do not get in the way upon operation of the mount device.
7. In accordance with the mount device for connection of filament-shaped connecting bodies, according to the invention, it is possible to correctly convey a collecting body composed of filament-shaped connecting bodies to the striking position for connection.
8. In accordance with the mount device for connection of filament-shaped connecting bodies, according to the invention, the grasping operation of the lever enables sure engagement of a collecting body composed of filament-shaped connecting bodies while feeding the same to a position of engagement in good order and without tangling.
9. In accordance with the mount device for connection of filament-shaped connecting bodies, according to the invention, grasping of the lever enables stopping the head conveying arm in the foremost advancing position whereby a head can be positioned precisely in front of the hollow needle for sure connection with a joining part.
10. In accordance with the mount device for connection of filament-shaped connecting bodies, according to the invention, grasping of the lever enables stopping the head conveying arm in the foremost advancing position with the fourth link brought into contact with the shaft, so that a head can be positioned and stopped precisely in front of the hollow needle.
11. In accordance with the mount device for connection of filament-shaped connecting bodies, according to the invention, the head conveying arm can be stopped relative to the body and grasped surely in a state, in which it is returned in front of the body to be received therein.
12. In accordance with the mount device for connection of filament-shaped connecting bodies, according to the invention, the head conveying arm can be magnetically attracted to the body to be surely stopped and grasped surely in a state, in which it is returned in front of the body to be received therein.
13. In accordance with the mount device for connection of filament-shaped connecting bodies, according to the invention, the ratchet wheels adapted to engage with and convey a collecting body composed of filament-shaped connecting bodies can be operated from outside the body, so that advancing and retreating operations of the collecting body can be simply performed to take out connecting bodies in the course of connection.

14. In accordance with the mount device for connection of filament-shaped connecting bodies, according to the invention, reverse rotation of the ratchet wheels adapted to engage with and convey a collecting body composed of filament-shaped connecting bodies can be prevented by engaging stoppers with the ratchet wheels and the collecting body can be taken out by disengaging the stoppers from the ratchet wheels.

15. In accordance with the filament-shaped connecting bodies, according to the invention, a collecting body composed of filament-shaped connecting bodies is formed by providing a multiplicity of filament-shaped connecting bodies between two flexible members with connecting parts therebetween, and providing a latch hole in the head and a joining part perpendicularly to a plane where the multiplicity of connecting bodies are arranged, so that loading and connection of the collecting body become much easy.

16. In accordance with the filament-shaped connecting bodies, according to the invention, latch pawls are provided on a periphery of a latch hole to face each other, so that when a joining part is fitted into a head, a base portion of the joining part can be surely protected by the latch pawls to be put into a sealed condition.

What is claimed is:

1. A mount device for connection of filament-shaped connecting bodies, comprising a lever supported on a forward portion of a grip part of a hollow body to appear and disappear, an intermediate lever driven by the lever, a piston, which is guided to move in a forward and backward direction of the body and with which the intermediate lever engages, a rod extended forward from the piston for pushing out a joining part, a hollow needle disposed axially of the rod to be mounted in the body, a gear feed lever adapted to turn upon reciprocation of the piston, a joining part feed gear and a head feed gear, which are disposed in a forward end portion of the body, ratchet wheels, respectively, provided adjacent the both gears, feed pawls incorporated into pawl support parts provided at a tip end of the gear feed lever and adapted to mesh with the ratchet wheels, respectively, a head groove and a join groove, which are formed to communicate to feed positions of the joining part and of the head on peripheral surfaces of the joining part feed gear and the head feed gear, and a head conveying arm driven by the piston and supported by linkage having parallel links, and wherein the head conveying arm in a head grasping position grasps a foremost head from the head feed gear, to which filament-shaped connecting bodies are supplied, and moves the same from the head grasping position as the head conveying arm moves along a predetermined path by means of the linkage supporting the head conveying arm to a joining part receiving position to make the same stand by immediately before a discharge port of the hollow needle, and in the mean time the rod projecting at a tip end of the piston causes a foremost joining part in a position of the joining part feed gear, to which filament-shaped connecting bodies are supplied, to be inserted and latched into the latch hole of the head grasped by the head conveying arm in the joining part receiving position.

2. The mount device for connection of filament-shaped connecting bodies, according to claim 1, wherein heads and joining parts of filament-shaped connecting bodies are intermittently pushed out to be connected to each other by the gripping operation of the lever, which is provided on a forward portion of a grip part of the body of the mount device in a manner to be elastically pushed out;

the gripping operation of the lever causes the gear feed lever to turn interlocking with advancement of the piston, and stores an elastic force in a spring connected to the gear feed lever upon turning of the gear feed lever, and the releasing operation of the lever causes the gears to rotate making use of the elastic force of the spring;

and the gear feed lever stores an elastic force in the spring in a former stage of the turning, and in a latter stage performs connection of the head and the joining part with each other in a state, in which the elastic force is preserved in the spring, and releases the elastic force from the spring upon the releasing operation of the lever to thereby convey the filament-shaped connecting bodies.

3. The mount device for connection of filament-shaped connecting bodies, according to claim 1, wherein the gear feed lever comprises a guide surface for inclining the lever interlocking with advancement of the piston in a former stage of the gripping operation of the lever to store an elastic force in a spring, and a guide surface contiguous to the guide surface in a doglegged configuration for maintaining a posture of the lever in a latter stage of the gripping operation during advancement of the piston, and a guide body, which is turnably provided to cooperate with the guide surface to assume a V-shape and of which a tip end is contiguous to the guide surface;

an elastic force is stored in the spring while an actuating part adapted to move on the guide surface together with the piston moves, connection of a connecting body is carried out while the actuating part moves on the guide surface, a posture of the lever is maintained while the actuating part moves on a guide surface of the guide body, and when the actuating part gets out of an end of the guide body, the elastic force of the spring causes the gear feed lever to swing to move a filament-shaped connecting body to a succeeding striking position.

4. The mount device for connection of filament-shaped connecting bodies, according to claim 3, wherein the joining part feed gear and the head feed gear are provided in a forward portion of the body, and paths are formed in the body, along which flexible members of the filament-shaped connecting bodies are caused to engage with halves of peripheries of the both gears, and are discharged.

5. The mount device for connection of filament-shaped connecting bodies, according to claim 1, further comprising pawl support parts, respectively, formed on a tip end of the gear feed lever in a bifurcate manner, and feed pawls provided on and supported by the pawl support parts to mesh with ratchet wheels, respectively, which are provided adjacent the joining part feed gear and the head feed gear, and to project forward by elastic forces.

6. The mount device for connection of filament-shaped connecting bodies, according to claim 1, further comprising a manual feed roller arranged midway between the ratchet wheels to drive them.

7. A mount device for connection of filament-shaped connecting bodies, comprising a lever supported on a forward portion of a grip part of a hollow body to appear and disappear, an intermediate lever driven by the lever, a piston, which is guided to move in a forward and backward direction of the body and with which the intermediate lever engages, a rod extended forward from the piston for pushing out a joining part, a hollow needle disposed axially of the rod to be mounted in the body, a gear feed lever adapted to turn upon reciprocation of the piston, a joining part feed gear and a head feed gear, which are disposed in a forward end portion of the body, ratchet wheels, respectively, provided adjacent the both gears, feed pawls incorporated into pawl support parts provided at a tip end of the gear feed lever and adapted to mesh with the ratchet wheels, respectively, a head groove and a join groove, which are formed to communicate to feed positions of the joining part and of the head on peripheral surfaces of the joining part feed gear and the head feed gear, a head conveying arm driven by the piston and supported by a linkage having parallel links, a first base plate and a second base plate arranged in parallel between a righthand body and a lefthand body, which constitute the body, the joining part feed gear and the head feed gear being disposed on a forward portion of one surface of the first base plate, a head groove and a join groove provided in a longitudinal direction of the body in a manner to communicate to feed surfaces of the joining part feed gear and the head feed gear, the rod being provided on the piston in a manner to move transversely in a diametrical direction of the joining part feed gear, the hollow needle being disposed forwardly axially of the rod, the second base plate being provided on one surface thereof with a guide groove for guiding the piston, and with a first link, a second link, a third link and fourth links, which are driven by the piston, the head conveying arm pivotally mounted to upper ends of the third link and of the fourth links defining a parallel linkage, and the gear feed lever, the ratchet wheels driven by the gear feed lever, and the joining part feed gear and the head feed gear, which are fixed to shafts of the ratchet wheels wherein the head conveying arm grasps a foremost head from the head feed gear, to which filament-shaped connecting bodies are supplied, and moves the same along a predetermined path by means of the linkage supporting the head conveying arm to make the same stand by immediately before a discharge port of the hollow needle, and in the mean time the rod projecting at a tip end of the piston causes a foremost joining part in a position of the joining part feed gear, to which filament-shaped connecting bodies are supplied, to be inserted and latched into the latch hole of the head grasped by the head conveying arm.

8. The mount device for connection of filament-shaped connecting bodies, according to claim 7, further comprising a stoppage mechanism for maintaining a position where parts constituting the parallel linkage inclines foremost.

9. The mount device for connection of filament-shaped connecting bodies, according to claim 8, wherein the stoppage mechanism is actuated upon contact of an end of at least one of the fourth links with a shaft of the head feed gear.

10. The mount device for connection of filament-shaped connecting bodies, according to claim 7, further comprising a stoppage member provided between the head conveying arm and the body to prevent vibration in a position where the head conveying arm is returned.

11. The mount device for connection of filament-shaped connecting bodies, according to claim 10, wherein the stoppage member comprises members for providing magnetic attraction and fixing between the head conveying arm and the body.

12. The mount device for connection of filament-shaped connecting bodies, according to claim 7, further comprising stoppers arranged on sides of the ratchet wheels, and a stopper release body for releasing engagement between the stoppers and the joining part feed gear and the head feed gear.

* * * * *